United States Patent [19]

Geisow

[11] 4,340,088

[45] Jul. 20, 1982

[54] PRESSURE BALANCED SAFETY VALVE FOR WELLS AND FLOW LINES

[75] Inventor: Bernard H. Geisow, Houston, Tex.

[73] Assignee: Daniel Industries, Inc., Houston, Tex.

[21] Appl. No.: 157,377

[22] Filed: Jun. 9, 1980

[51] Int. Cl.[3] ..... E21B 43/12

[52] U.S. Cl. ..... 137/629; 166/324; 166/332; 251/58

[58] Field of Search ..... 137/629; 166/324, 332, 166/334; 251/58

[56] References Cited

U.S. PATENT DOCUMENTS

| | | | |
|---|---|---|---|
| 3,830,297 | 8/1974 | Cockrell | 137/629 X |
| 3,868,995 | 3/1975 | Crowe | 137/629 X |
| 4,103,744 | 8/1978 | Akkerman | 137/629 X |

*Primary Examiner*—Robert G. Nilson

*Attorney, Agent, or Firm*—Gunn, Lee & Jackson

[57] ABSTRACT

A safety valve for the production tubing of wells and/or fluid flow lines includes a valve element having both linear and rotary components of movement within a valve body and is actuated by a lost-motion rack and pinion gear actuating mechanism. The clam-shell pinion gear is moved linearly within the valve body by a hydraulic sleeve piston actuator for inducing valve movement responsive to hydraulic control of the sleeve piston. The sleeve piston is also responsive to upstream pressure for pressure actuation of the valve to its closed position. The valve element is also mechanically movable to its closed position. To facilitate opening movement of the valve, after an initial part of the opening movement of the sleeve piston assembly has occurred, pressure upstream of the valve element is communicated with the downstream side of the valve element, thus balancing pressure across the valve element and dissipating any pressure induced resultant forces that oppose valve opening movement. A lost-motion, spring biased sleeve piston interconnection between upper and lower piston sleeve sections is constructed to allow collapsing of the piston sleeve assembly but restrains separation of the sleeve sections. The sleeve interconnection also protects piston springs from torque forces during rotation of the piston sleeve.

35 Claims, 16 Drawing Figures

FIG.1
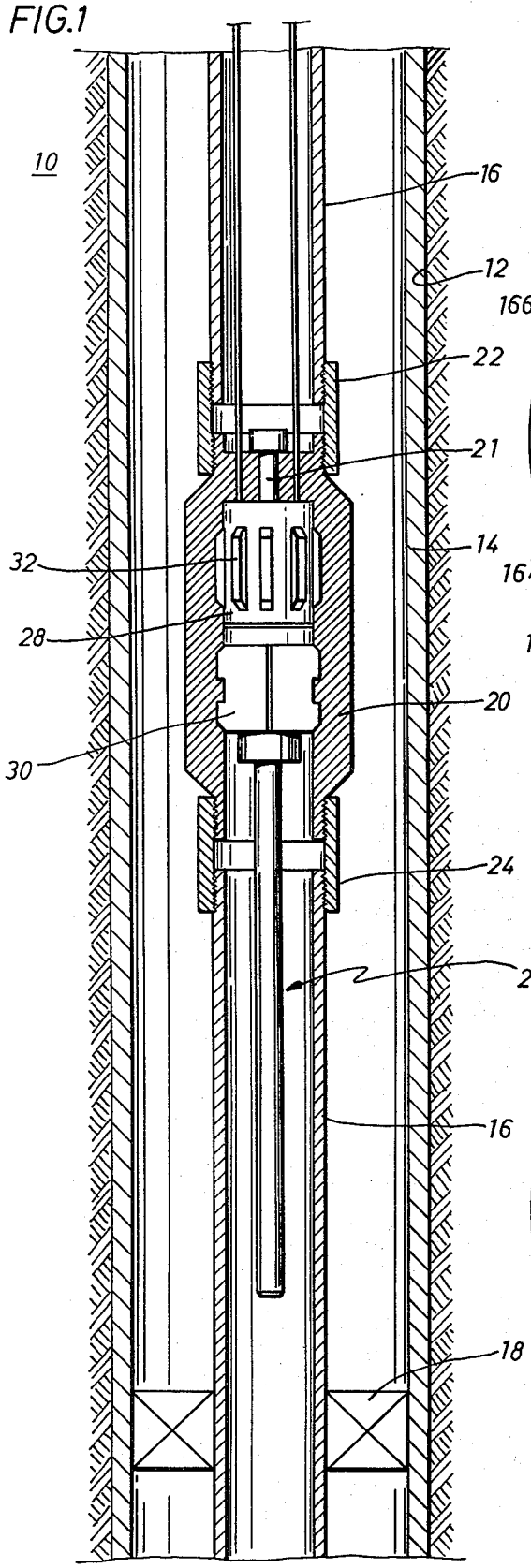
FIG. 3
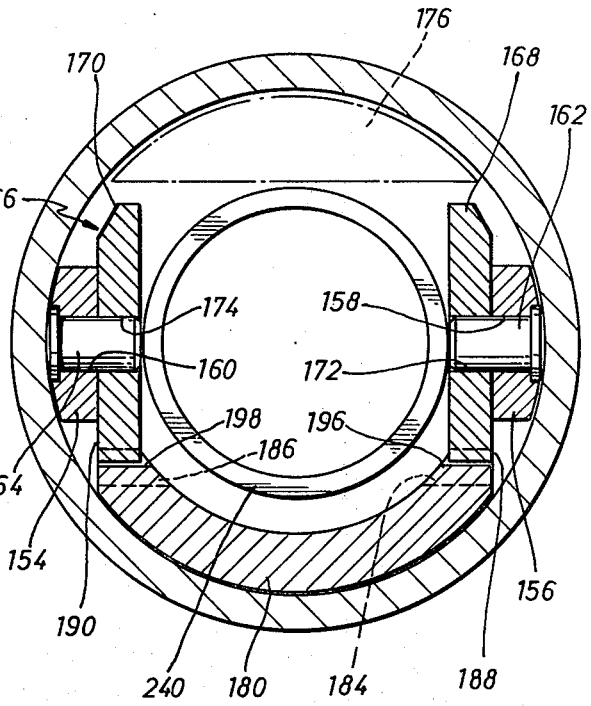
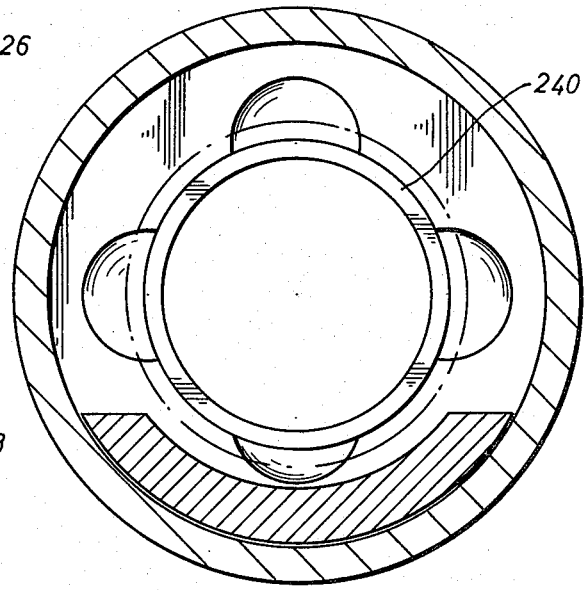
FIG.5

PRESSURE BALANCED SAFETY VALVE FOR WELLS AND FLOW LINES

FIELD OF THE INVENTION

This invention relates to the subject matter of U.S. patent application Ser. No. 963,459, filed on Nov. 24, 1978 on behalf of Bernard H. Geisow and entitled ACTUATABLE SAFETY VALVE FOR WELLS AND FLOW LINES.

This invention relates generally to pressure sensitive and velocity-sensitive safety valves for controlling the flow in well production and other flow lines in the event an unsafe flow condition is sensed. More particularly, the invention also relates to safety valve mechanisms that are controllably actuatable for purposes of selective flow control and are automatically actuatable as a storm choke or safety valve responsive to sensing a predetermined fluid flow condition at the valve. Even more particularly, the valve mechanism relates to a valve apparatus defining a straight through unobstructed flow passage that allows objects to be passed therethrough in the open condition of the valve.

To facilitate ready understanding, this invention is discussed herein particularly as it relates to a downhole well environment. It is not intended to so limit the invention, however, it being within the scope hereof to employ the invention in other flow control applications.

The term "storm choke" is typically utilized in the well completion and production industry where deep wells are completed for the purpose of producing petroleum products, such as gas, oil, etc. A storm choke is typically located in a production tubing string within a well for the purpose of automatically shutting off production from the well when conditions arise that are potentially hazardous to the operation and safety of the well or when the operator of the well desires to cease production through closure of a valve located within the well itself. For example, in the event a flow line should rupture at the wellhead or immediately downstream thereof, it is desirable to provide means for insuring that production is shut in as rapidly as possible. Obviously, certain abnormal flow conditions which occur, such as by rupture of a flow line or the like, develop a potentially hazardous condition to personnel and equipment. In cases where petroleum products are being produced, a potential fire hazard exists when a flow line rupture occurs, especially in land based well operations. Where production of petroleum products is accomplished in an offshore or marine environment, the additional hazards of this environment due to wave action, debris, moving equipment, etc. makes the provision of storm chokes in wells even more necessary. It is desirable that production of petroleum products be allowed to continue even though the wells may be left unattended for long periods of time and even though a potentially dangerous condition, such as a storm, for example, might exist. In the event, however, the flow lines or other fluid production components of the well should become damaged to the extent that leakage occurs, this leakage is automatically sensed and results in automatic shut in of the well by virtue of the storm choke. It is desirable that a well, thus shut in, will remain out of production until such time as repairs are made. Properly functioning storm choke systems will prevent undesirable loss of production fluid and will protect the environment against pollution by petroleum products and protect other equipment from becoming damaged or destroyed such as might otherwise occur if a damaged well production facility should flow in uninterrupted manner for an extended period of time.

Often, it is necessary or desirable to shut off a well for maintenance work at the wellhead or for other reasons. Hence, it is desirable that the well may be readily placed back in production after operation of the storm choke without the necessity of killing the well with fluids followed by swabbing, back-circulation, or other well completion procedures.

After a downhole safety valve or storm choke has been actuated to its closed position for any reason, formation pressure typically develops a pressure differential across the closed valve element, thus developing a pressure induced resultant force that continuously urges the valve element toward its closed condition. To open the valve, it is necessary to apply an opening force thereto which overcomes this resultant force and also overcomes any mechanically induced forces that might also urge the valve element toward its closed condition. At times, this required opening force is of significantly great magnitude that the mechanical valve opening apparatus may become excessively worn or damaged during use thus causing frequent valve failure. Especially in a downhole well environment, the necessary small size of safety valve apparatus can adversely affect the physical dimensions and thus inherent strength of the valve opening apparatus. It is desirable therefore to minimize the required opening force of the valve and thus allow the valve opening mechanism to more adequately accommodate the opening force.

It is desirable that a storm choke be capable of being used with conventional well completion methods and wellhead equipment. The storm choke can also be dimensionally suitable for installation in standard casing sizes employed in wells and still provide full opening ports which will offer no restrictions preventing the running of instruments or other tools through the device. The ports through which production fluid from the well flows should be sufficiently large in dimension to minimize cutting by sand that might be carried with the production fluid.

In many cases, downhole production control devices such as storm chokes are subjected to a highly erosive and/or corrosive environment, depending upon the nature of the production fluid. In many cases it is desirable to periodically remove such apparatus from the well for repair or replacement, thereby insuring that the apparatus is always maintained in serviceable condition. In order to limit the expense involved in such repair and replacement operations, it is desirable to connect storm choke apparatus to wire line tool systems so that it will not be necessary to remove an entire production tubing string from the well in order to change out a storm choke. Moreover, in multiple completion systems, it may be desirable to cease production from a particular well zone while production is allowed to continue from different production formations. It may be desirable therefore to provide independent tubing strings for producing different production zones with a storm choke system being provided for each of the tubing strings. The storm chokes can be installed and retrieved by means of wire line systems thereby simplifying repair operations and maintaining repair costs at an acceptably low level.

In most cases, storm chokes and other downhole valve equipment define a rather circuitous flow path for the production fluid medium. Also, in some cases it is desirable to run well servicing tools through the valve mechanism in order to achieve downhole servicing operations. In such cases it is desirable to provide a valve mechanism having a straight through flow passage and yet being capable of closing in response to sensing an abnormal flow condition requiring automatic valve shutoff.

In many cases, storm chokes remain open responsive to forces developed by a compression spring and, when the force of the spring is overcome by the abnormal flow position, the valve mechanism will be moved to its closed position and it will remain closed until such time as pressure is supplied through the tubing string from the wellhead. It is desirable to provide a valve mechanism that functions automatically responsive to sensing an abnormal flow condition to shut off production flow through the tubing string and yet provide effective control of the valve mechanism by appropriate manipulation of surface control equipment.

Most storm choke type valve mechanisms incorporate a valve element such as a ball valve, check valve, etc. which is exposed to the flowing production fluid medium. Since the production fluid will typically contain quantities of particulate, such as sand and other debris, such valve mechanisms can easily become eroded or fouled to such extent that proper operation of the valve mechanism is not possible. It is desirable to provide a storm choke type valve mechanism incorporating a valve element that is completely shielded from the following production fluid during operation.

In cases where valve leakage is not allowed, it is desirable to provide a valve mechanism incorporating a valve element, which valve mechanism is not in any way exposed to the environment outside of the valve body. In cases where leaked fluid may be hazardous to the environment, or hazardous from the standpoint of fire, etc., it may be desirable to provide a valve body structure that completely encloses the valve mechanism and precludes any leakage whatever exteriorly of the flow line.

THE PRIOR ART

Subsurface safety valves, commonly referred to as storm chokes, are quite well known in the well production industry, having been employed for many years in pressurized petroleum well systems. In some cases, the storm choke is located in the wellhead structure, as shown by U.S. Pat. No. 3,724,501, and, in other cases, storm chokes are located within a tubing string as shown by U.S. Pat. Nos. 3,799,192 and 2,785,755. In some cases, storm chokes are located at the lower extremity of a string of production tubing as shown by U.S. Pat. No. 3,035,808. Subsurface safety valves have also been developed that function solely in response to conditions sensed within the well, as in U.S. Pat. No. 3,757,816, while other subsurface valve mechanisms are controllable from the surface as well as being responsive to abnormal well conditions, as in U.S. Pat. No. 4,069,871. Downhole safety valve apparatus is also disclosed by U.S. Pat. Re No. 26,149 wherein swing check valve segments are operated by a rack and pinion system.

SUMMARY OF THE INVENTION

With the foregoing in mind, it is a primary feature of the present invention to provide a novel valve mechanism that may be efficiently utilized as a downhole valve mechanism or storm choke or may conveniently take the form of an in-line safety valve for general flow line use.

It is also a feature of the present invention to provide a novel valve mechanism incorporating a valve element having both linear and rotary components of movement within a valve body to allow direct seating and unseating movement and to allow the valve element to be freely rotated between the open and closed positions thereof.

It is an even further feature of the present invention to provide a novel valve mechanism incorporating a pivotal valve element that may be pivotally moved out of the flowstream to allow uninterrupted flow of fluid in the open position thereof and to further allow passage of tools and other devices through the valve mechanism as desired.

Among the several objects of the present invention is noted the contemplation of a novel valve mechanism incorporating a valve element that is retractable or positionable within a protective enclosure and is protected against contact with the flowing fluid during operation of the valve.

It is an even further feature of the present invention to provide a novel valve mechanism that functions efficiently as a safety valve responsive to sensing abnormal flow conditions and also functions as a controllable valve to achieve controlled operation as desired.

It is an even further feature of the present invention to provide a novel valve mechanism that may be installed and removed by wire line equipment, thus precluding any necessity for removing a tubing string in order to achieve servicing of the valve mechanism.

Another feature of this invention concerns the provision of a novel valve mechanism wherein pressure across the valve element is balanced during an initial portion of the valve opening movement, thus eliminating any pressure induced resultant force from the valve opening movement.

These and other features of the present invention are attained in accordance with the concept of the present invention through the provision of a valve mechanism incorporating a valve body that is connectable to a flow line or tubing string in any desired manner. A valve element is movably positioned within a valve chamber defined within the valve body and is movable with both rotary and linear components of movement so as to be linearly movable into and away from seated engagement with a valve seat and is pivotally movable from a position within the flow passage to a protected, retracted position within a protective receptacle also defined within the valve body. Actuation of the valve element between its open and closed positions is accomplished by means of an elongated sleeve type piston actuator assembly employing upper and lower actuator sleeves that cooperate with the valve element to define a rack and pinion gear type valve actuating system. The clam-shell or partially spherical valve element defines a partial pinion gear construction that is movable by the piston sleeve assembly. The partial pinion gear construction accomplishes rotation of the valve element responsive to linear movement of the piston sleeve.

The sleeve type piston actuator assembly incorporates upper and lower piston sections that are interconnected by a lost-motion assembly incorporating compression spring means that urge the piston sections to an extended position thereof. During an initial portion of the opening movement of the valve mechanism, the upper piston sleeve section will move toward the lower piston section by compressing the spring means thus allowing movement of the lost-motion connection. Movement of the upper piston sleeve section opens a passageway and establishes fluid communication of upstream pressure to the downstream side of the valve element. This pressure balancing activity dissipates any pressure induced resultant force acting on the valve element and thus eliminates any requirement for an extremely heavy duty valve actuating mechanism. Since the opening force of the valve actuator need to overcome only the mechanically induced force of the valve actuating springs and other minimal frictional forces, a valve actuation of only nominal mechanical strength will function efficiently over an extended service life without requiring servicing due to metal fatigue or failure due to excessive load conditions. Further, since the pressure conditions within a well can change drastically, a valve mechanism designed for low pressure conditions will be capable of functioning properly even under circumstances where drastic pressure increases may be encountered.

Within the valve mechanism may be provided a compression spring that is adapted to maintain the valve mechanism in the closed position thereof in absence of an opposing force supplied in the form of hydraulic fluid introduced into the piston chamber and acting upon one extremity of the piston element. For downhole application, closure of the valve mechanism is also enhanced by formation pressure or line pressure that acts upon the opposite extremity of the sleeve piston element and enhances the force developed by the closure spring.

Other and further objects, advantages and features of the present invention will become apparent to one skilled in the art upon consideration of this entire disclosure, including this specification and the annexed drawings. The form of the invention, which will now be described in detail, illustrates the general principles of the invention, but it is to be understood that this detailed description is not to be taken as limiting the scope of the present invention.

BRIEF DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings, which drawings form a part of this specification.

It is to be noted, however, that the appended drawings illustrate only a typical embodiment of the invention and is, therefore, not to be considered limiting of its scope, for the invention may admit to other equally effective embodiments.

In the Drawings:

The present invention, both as to its organization and manner of operation, together with further objects and advantages thereof may best be understood by way of illustration and example of certain embodiments when taken in conjunction with the accompanying drawings in which:

FIG. 1 is a pictorial representation, partly in section, illustrating a storm choke type downhole safety valve mechanism installed within a well by means of a wire line retrieval mechanism.

Figure 2A:
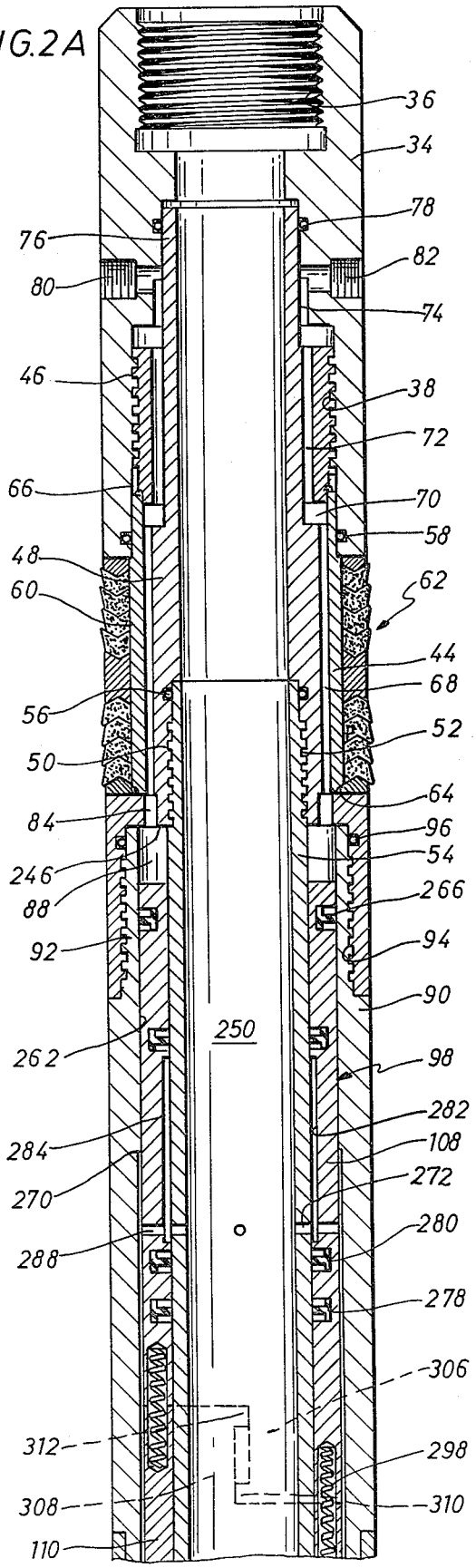

FIG. 2A is a sectional view of the upper section of a downhole type safety valve or storm choke constructed in accordance with the present invention.

Figure 2C:
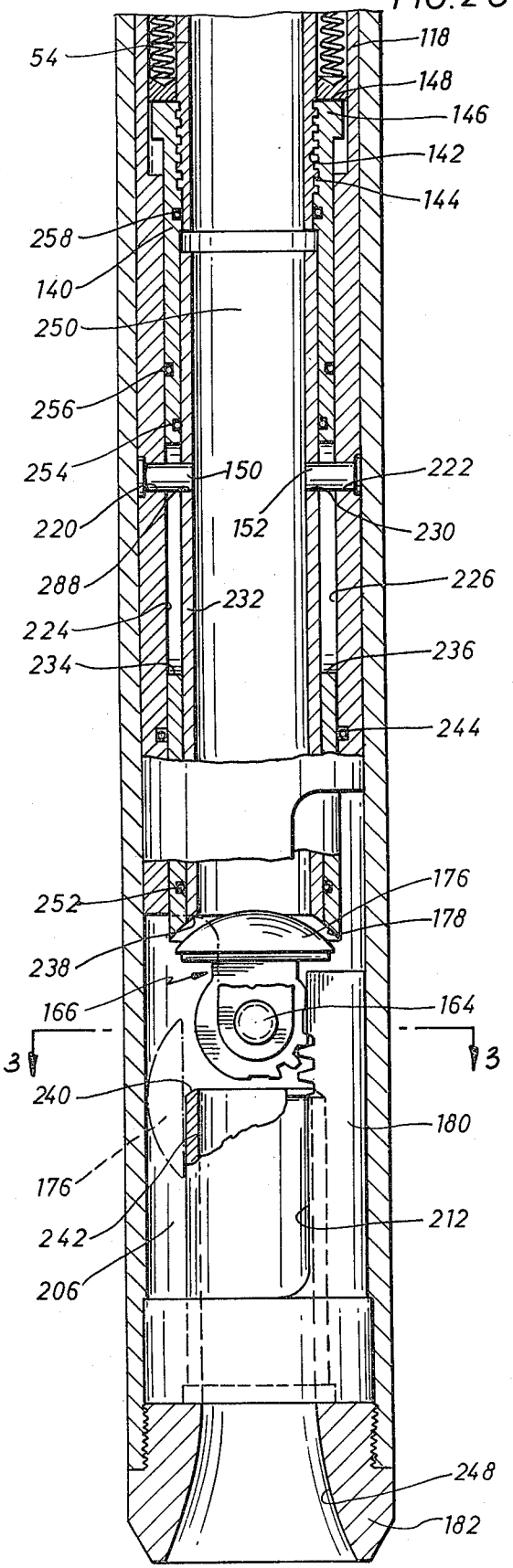
Figure 2B:
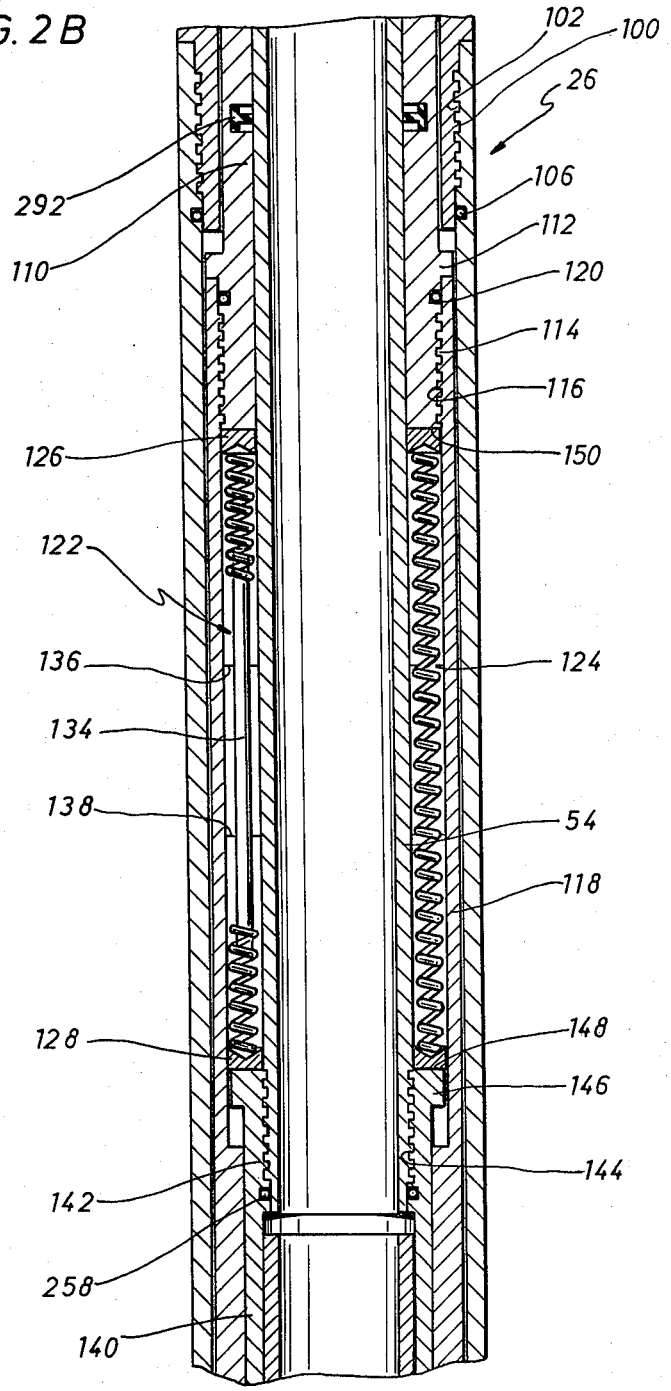

FIG. 2B is a sectional view of the intermediate portion of the valve mechanism.

FIG. 2C is a sectional view of the lower portion of the downhole valve mechanism of FIG. 2A showing the valve element in registered but unseated relation with the valve seat.

FIG. 3 is a partial sectional view of the valve mechanism of FIG. 2C taken along line 3—3 of FIG. 2C.

Figure 4:
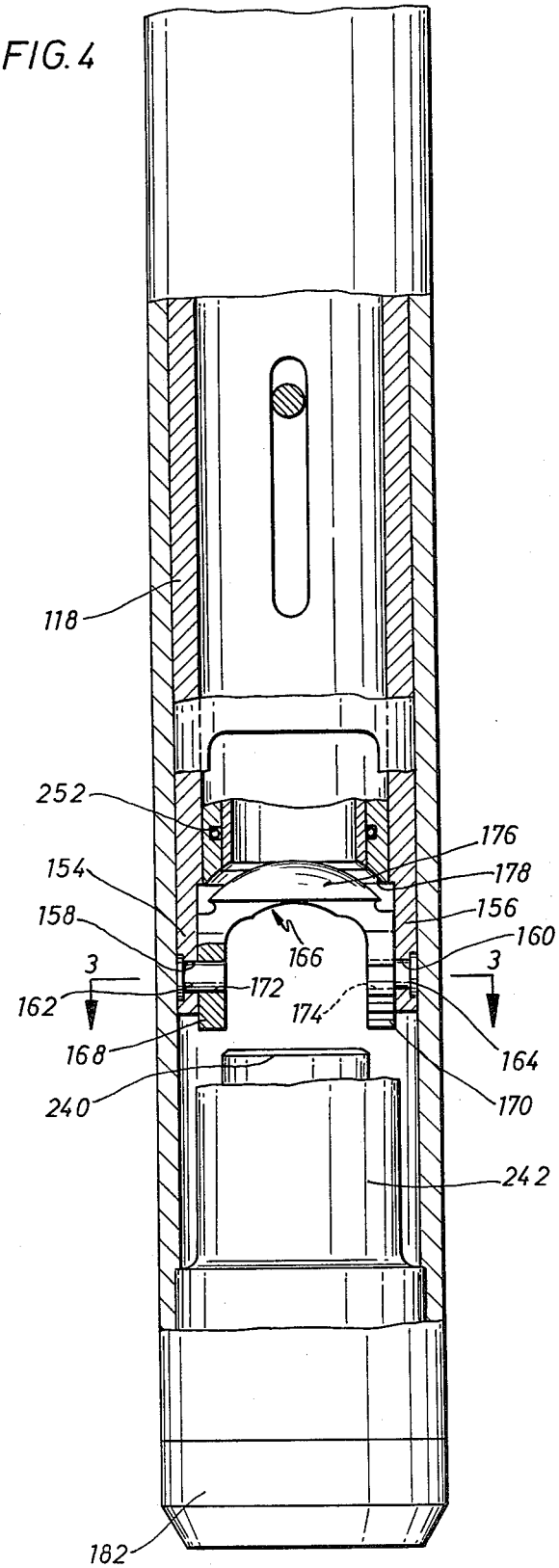

FIG. 4 is a sectional view of the valve mechanism taken along line 4—4 of FIG. 3 and illustrating the valve element as being slightly retracted out of blocking relation with the flow passage of the valve.

FIG. 5 is a sectional view taken along line 5—5 of FIG. 2C.

Figure 6B:
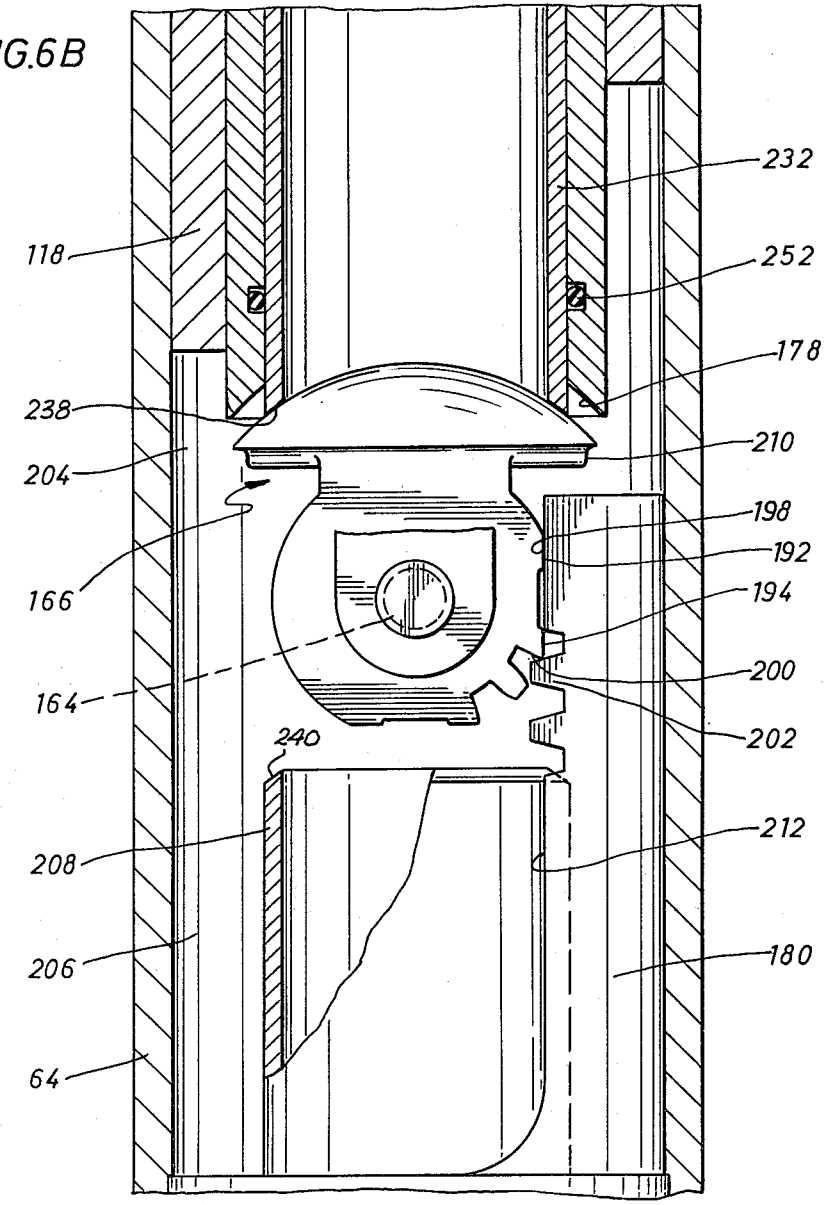
Figure 6A:
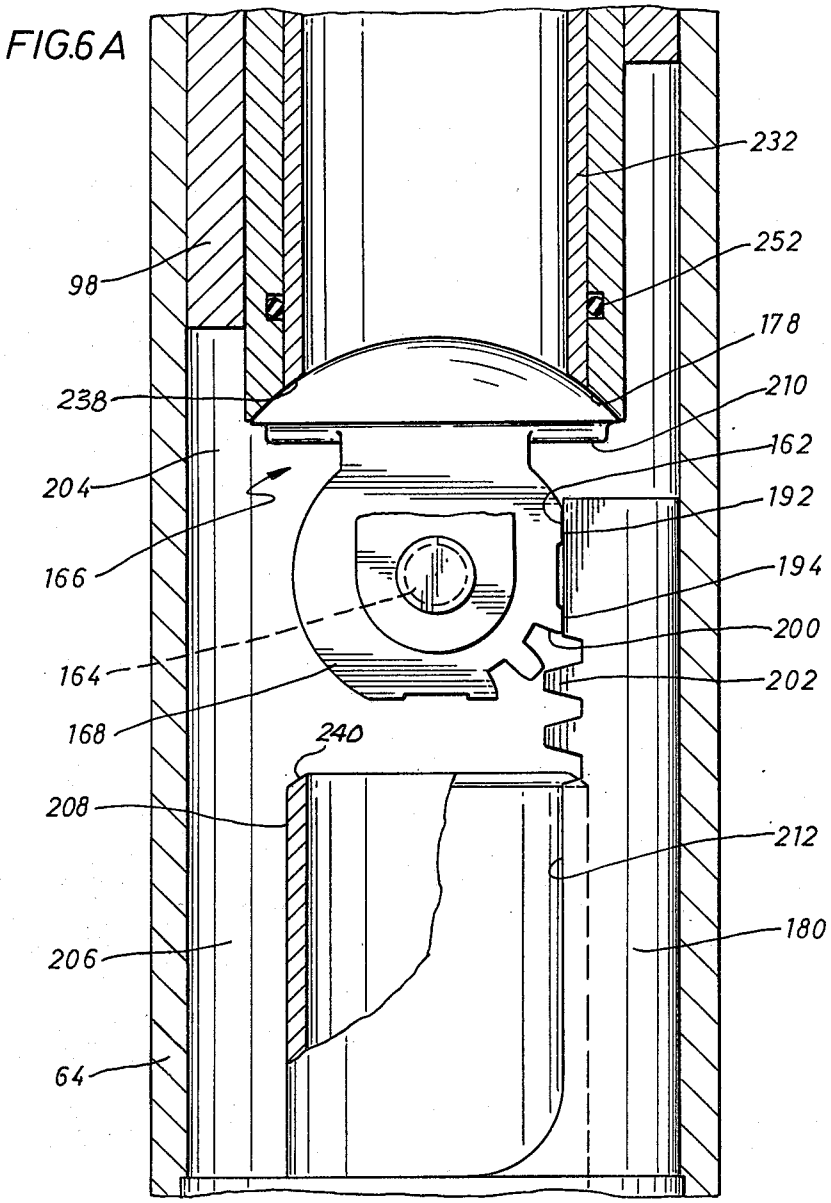

FIG. 6A is a partial sectional view of the safety valve mechanism illustrated in FIG. 2 and illustrating the valve element in its fully closed position.

FIG. 6B is a partial sectional view of the valve mechanism illustrated in FIG. 2 with the valve element being linearly retracted from the valve seat and being positioned for 90° rotation.

Figure 6D:
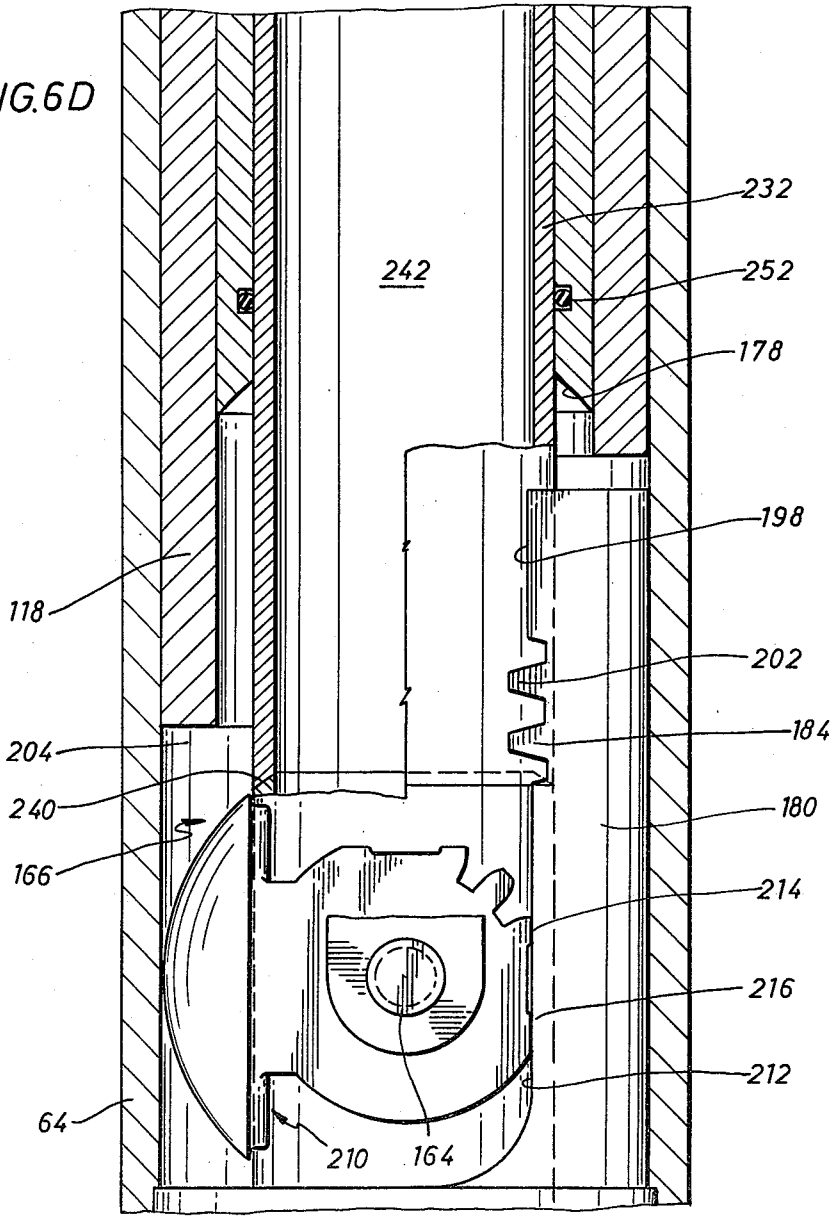
Figure 6C:
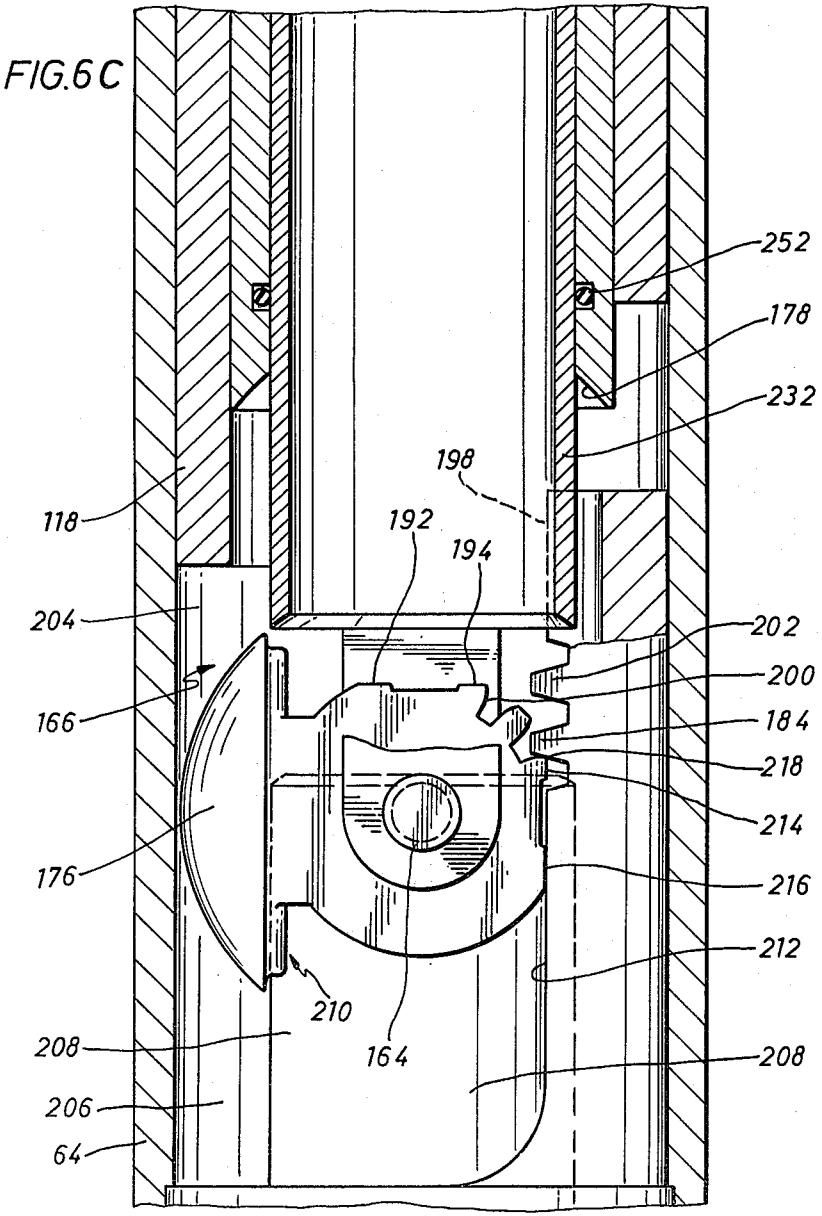

FIG. 6C is a partial sectional view of the valve mechanism of FIG. 2 illustrating the valve element at the end of its 90° rotational movement.

FIG. 6D is also a partial sectional view of the valve mechansim of FIG. 2 illustrating the valve element in its fully retracted position within the protective receptacle and showing the masking tube in its fully seated position, thus isolating the valve element from the path of the flowing fluid through the valve mechanism.

Figure 7A:
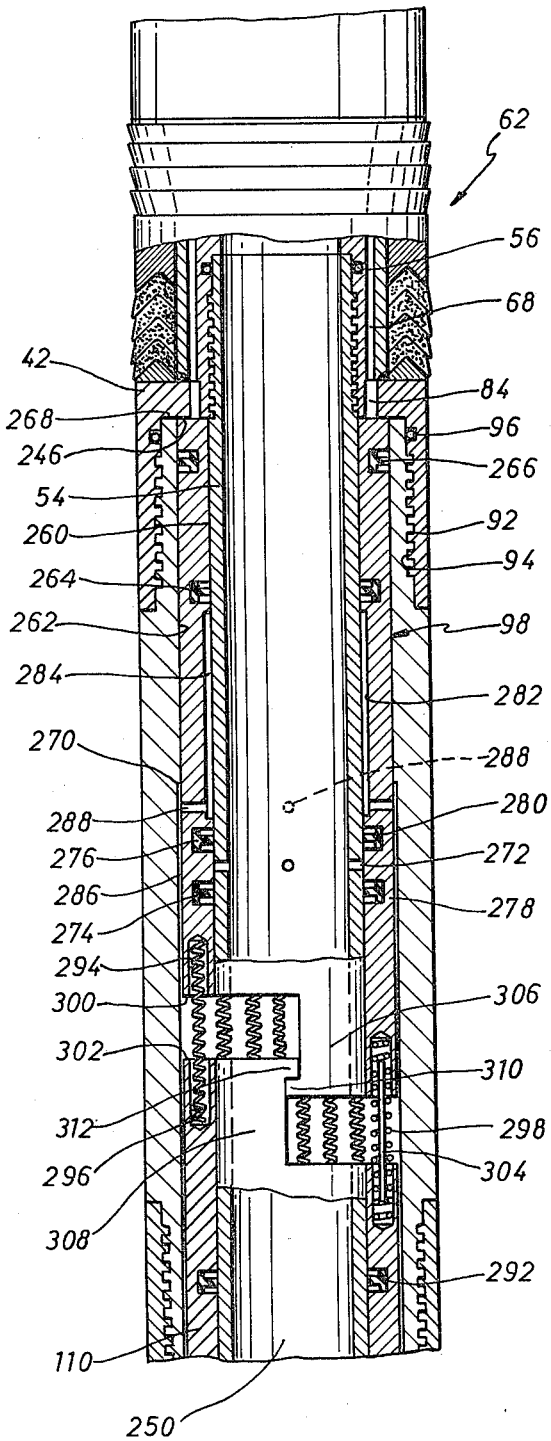

FIG. 7A is a partial sectional view of the structure illustrated in FIG. 2A, illustrating the lost-motion connection of the piston sleeve assembly in the extended condition thereof.

Figure 7B:
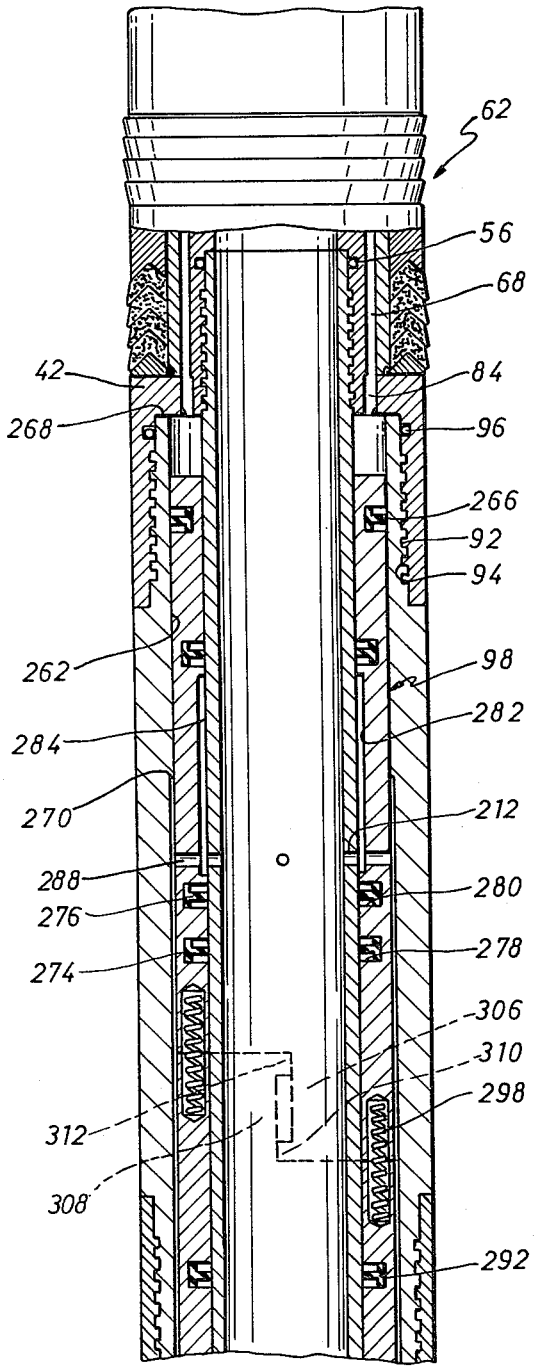

FIG. 7B is a partial sectional view of the structure illustrated in FIG. 2A, illustrating the lost-motion connection of the piston sleeve assembly in the collapsed position thereof facilitating pressure balancing of the valve element.

Figure 7C:
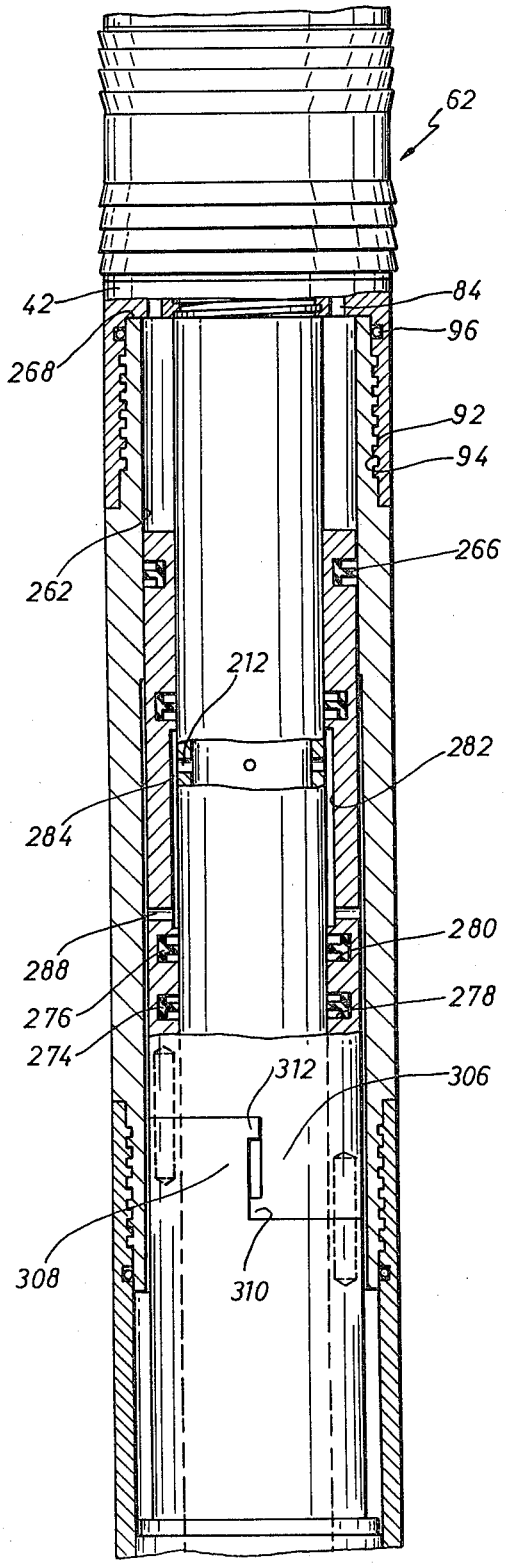

FIG. 7C is a partial sectional view of the valve mechanism similar to that of FIG. 7B and illustrating the piston assembly being moved downwardly to open the valve under pressure balanced conditions.

Figure 8:
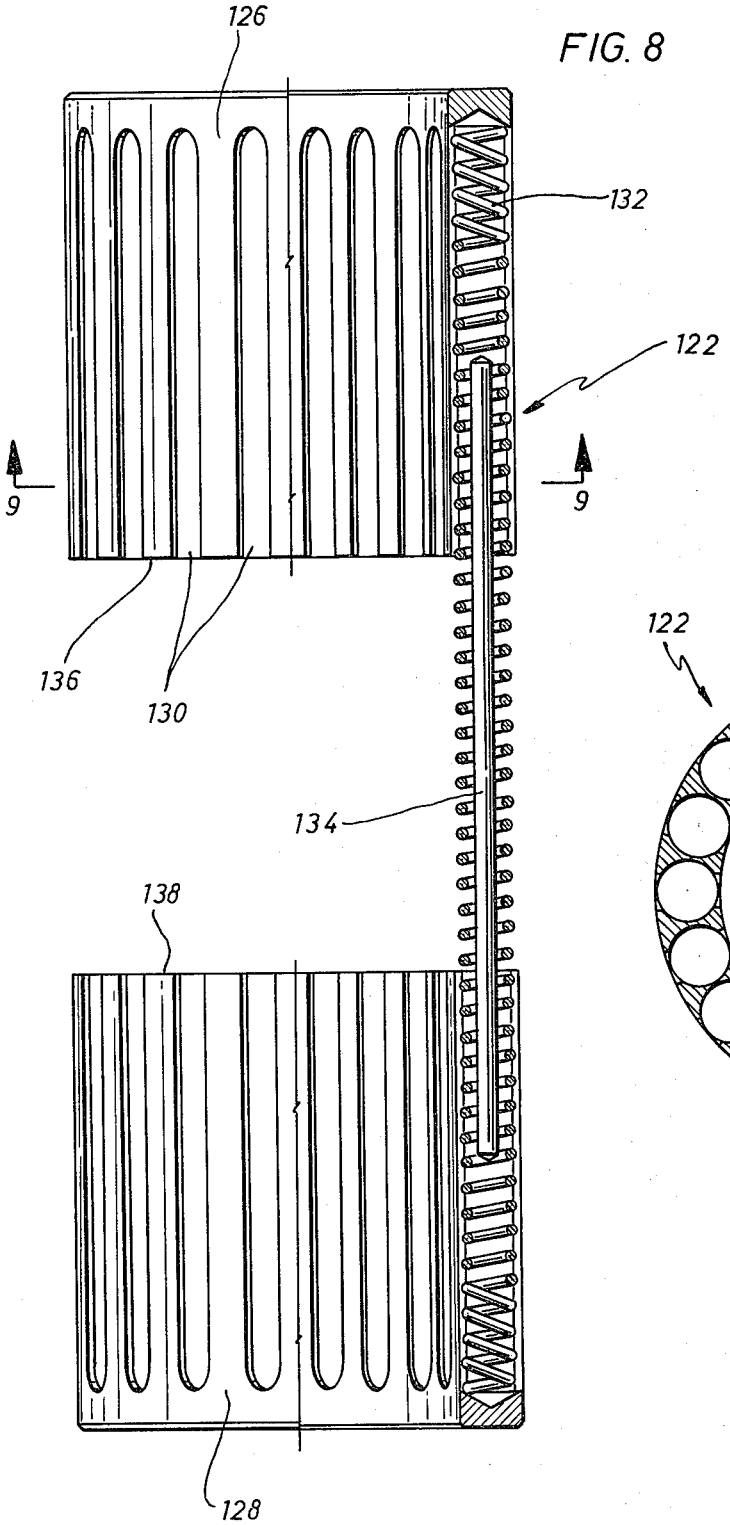

FIG. 8 is a partial sectional view of the primary compression spring package with a single helical spring and spring guide in place therein.

Figure 9:
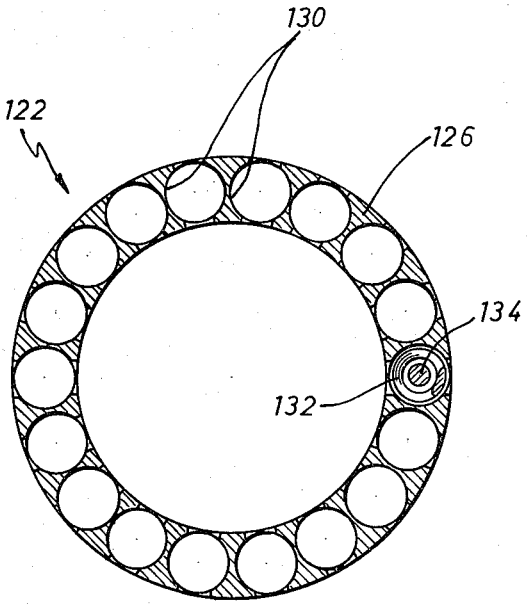

FIG. 9 is a sectional view taken along line 9—9 of FIG. 8.

DETAILED DESCRIPTION OF PREFERRED EMBODIMENTS

Referring now to the drawings and first to FIG. 1, a downhole safety valve installation is illustrated pictorially and partially in section. Within the earth formation 10, a well bore 12 is formed which bore is lined with a casing 14 that traverses the formation being produced. A string of production tubing 16 extends downwardly through the casing to the vicinity of the production formation and extends through a packer element 18. The lower portion of the production tubing is open to the casing in typical manner and the casing is perforated at the production zone in order to allow production fluid, including gas, oil and other fluid, to enter the casing and thus enter the production tubing. The packer element 18 seals off the production interval from the well casing thereabove.

Downhole safety valves are typically installed above a packer element in the manner illustrated in FIG. 1, especially where wire line installation is desired. Such wire line installation typically incorporates a landing nipple 20 that is connected into the tubing string 16 by means of collars 22 and 24. The downhole safety valve, illustrated generally at 26 and constructed in accordance with this invention, is secured to the lower extremity of a wire line setting and retreiving mandrel 28 that is capable of being seated and locked with respect to the landing nipple by means of locator keys 30 and locking drops 32 that are provided on the mandrel and are received within appropriate grooves within the landing nipple 20. The upper portion of the mandrel is typically provided with a wire line running and receiving neck so that the safety valve apparatus may be installed and removed by means of conventional wire line tools.

Referring now to FIG. 2A of the drawings, the safety valve mechanism of the present invention is shown to include a connection and support sub 34 having an internally threaded bore 36 formed at the upper extremity thereof for threaded connection to a wire line locking mandrel such as illustrated in FIG. 1. The connection and support body is formed to define an internally threaded lower portion 38 that is adapted for connection to the internally threaded upper portion 46 of an internal fluid supply housing section 48. The fluid supply housing section 48 is in turn formed to define an internally threaded lower portion 50 that is received in threaded engagement with an internally threaded upper portion 52 of an inner tubular housing portion 54 which is sealed with respect to the fluid supply housing section 48 by means of a suitable sealing element 56 such as an O-ring or the like that is received within an appropriate seal groove as shown. The connection and support sub 34 is also sealed with respect to the reduced diameter sleeve portion 44 of the body support sub by means of an appropriate sealing element 58 such as an O-ring or the like that is retained within an annular seal groove. The connection and support sub and the body support sub, together with the reduced diameter sleeve portion 44, cooperate to define an annular packing recess 60 within which is received a bidirectional chevron packing assembly illustrated generally at 62. The chevron packing assembly is enabled to establish sealing engagement with an internal cylindrical sealing surface defined within the wire line mandrel 28. The bidirectional chevron packing prevents well pressure from bypassing the wire line mandrel and flowing upwardly through the annulus between the production tubing and casing. Likewise, the bidirectional packing allows control pressure to be applied through the wire line mandrel 28 above the level of the packing for the purpose of opening the safety valve after the valve element has been moved to its closed position in the manner described hereinbelow. The reduced diameter sleeve portion 44 of the body support sub 42 is defined by a separate sleeve member that is interconnected with the body support sub by means of annular welds 64 and 66 and which cooperates with the inner surface portion of the sub to define a hydraulic fluid supply annulus 68 that communicates at its upper extremity with an annular channel 70 that interconnects a plurality of elongated hydraulic fluid supply bores 72 that intersect a fluid supply annulus 74 defined between an inner tubular portion 76 of the body support sub and the connection and support sub 34. The inner tubular portion 76 of the body support sub 42 is sealed with respect to the connection and support sub 34 by means of an annular sealing element 78 such as an O-ring or the like that is retained within an appropriate seal groove. Supply ports 80 and 82 establish communication between the hydraulic fluid supply passages of the apparatus and a fluid supply annulus that is defined between the apparatus and the internal surface portions of the wire line mandrel 28. Thus, when hydraulic fluid is supplied under pressure through the wire line mandrel, the upper seal portion of the bidirectional chevron seal prevents flow of pressurized hydraulic fluid by virtue of its sealed relationship with the inner sealing surfaces of the wire line mandrel. Pressurized hydraulic fluid therefore enters the fluid supply passages of the apparatus through supply ports 80 and 82 and flows downwardly through the passage system defined by reference characters 68, 70, 72 and 74. Pressurized hydraulic fluid from these passages will flow through a plurality of drilled holes 84 that are formed in a transverse wall structure 86 of the body support sub and will enter an annular piston chamber 88 that is defined by an annulus formed by the spaced relation of the inner tubular housing portion 54 and an outer intermediate housing section 90 of the safety valve mechanism. The intermediate housing section 90 is formed to define an externally threaded upper extremity 92 that is received in threaded interconnection with the lower internally threaded extremity 94 of the body support sub and is sealed relative thereto by means of an annular sealing element 96 such as an O-ring or a sealing element of any other suitable form. Within the piston chamber 88 is movably positioned an elongated sleeve piston assembly 98 which is urged by spring means to a valve closing position as shown in FIGS. 2B and 7A. The piston 98 is capable of being moved by pressurized hydraulic fluid to an intermediate position causing pressure balancing of the valve element as shown in FIG. 7B, and then to a valve open position where the valve element is maintained in its open condition to allow flow through the valve mechanism. The construction and function of the sleeve piston assembly, together with its valve pressure balancing activity, will be discussed in detail in connection with FIGS. 2B, 7A, 7B and 7C hereinbelow.

With reference particularly to FIG. 2B, the intermediate housing section 90 is formed to define an externally threaded lower extremity 100 that is received in threaded engagement with the upper internally threaded extremity 102 of a lower outer housing section 104. An O-ring 106 or other suitable annular sealing element, establishes a fluidtight seal between the intermediate and lower housing sections.

Referring now again to FIGS. 2A and 2B, the piston assembly 98 incorporates upper and lower relatively movable piston elements 108 and 110. The lower piston element 110 is formed to define an annular abutment flange 112 and defines a lower externally threaded portion 114 receiving the upper internally threaded portion 116 of a valve actuator sleeve 118. A sealed relationship is established between the valve actuator sleeve 118 and the lower piston element by means of an annular sealing element 120 retained within an annular groove formed in the piston element. As the lower piston element 110 is moved downwardly under the influence of hydraulic pressure within the piston chamber 88, the valve actuator sleeve element 118 is also moved downwardly by virtue of its threaded connection with the piston element. It is desirable to provide a mechanism for imparting upward movement to the lower piston element to thus return the valve actuator sleeve 118 to its upper, valve closing position. One suitable means for accomplishing return of the piston and the valve actuator sleeve may conveniently take the form illustrated in FIG. 2B, where a compression spring assembly is illustrated generally at 122, which spring assembly is located within an annular spring chamber 124 defined between the valve actuator sleeve 118 and the inner tubular housing portion 54. It should be borne in mind that the spring assembly 122 may, if desired, conveniently take the form of a simple helical compression spring without departing from the spirit and scope of the present invention. In view of the fact that the safety valve mechanism of this invention is designed for insertion through the tubing string of a well by means of conventional wire line tools, it is obvious that the maximum outside dimension of the valve mechanism is critical. Under circumstances where minimum size restrictions are imposed from the standpoint of diameter, the compression spring assembly will be required to be of restricted size and it may be difficult to provide a single helical compression spring capable of developing the required spring force for valve closing movement. Accordingly, the compression spring assembly may take the form illustrated particularly in FIG. 2B and shown in detail in FIGS. 8 and 9. Spring assembly 122 therefore incorporates a plurality of small sized elongated compression springs that are positioned in parallel spaced relationship and function in concert to develop the desired spring force. The spring assembly, which may also be referred to as a spring capsule, is dimensioned for insertion into the spring chamber 124 and incorporates a pair of generally cylindrical spring positioning elements 126 and 128. Each of the spring positioning elements are drilled or otherwise formed to define a plurality of elongated, slotted spring retainer receptacles 130. A plurality of compression springs 132 are provided having the extremities thereof disposed within respective ones of the spring receptacles of the spring positioning elements. In order to provide a more clear understanding of the present invention, the right-side portion of the spring assembly illustrated in FIG. 8 is broken away, showing only one of the compression springs 132 together with the relationship of the compression spring to each of the spring positioning elements.

Within each of the compression springs is provided an inner support rod 134 that is of sufficient length to bridge the space between the spring retainer elements 126 and 128 at the widest separation thereof. The inner support rods provide against transverse bending of the compression springs, thereby allowing each of the compression springs to develop maximum resistance upon being compressed by downward movement of the piston and actuating sleeve. Obviously, the maximum force potential of the spring assembly will be achieved when compression springs are retained within each of the receptacles. The force resistance of the spring capsule may be modified by eliminating some of the compression springs, thereby promoting a valve design incorporating a spring assembly that can be calculated to provide designed force resistance. The spring positioning elements are enabled to move into abutment under maximum force causing the opposed extremities 136 and 138 to become engaged so as to prevent further collapsing of the spring assembly and thereby prevent excessive compression of the springs. Also, the fully collapsed spring assembly provides a mechanical stop function to limit movement of the valve actuating sleeve 118, thus preventing severe forces from acting upon guide pin and stop elements 140 and 142.

Referring now again to FIG. 2C, a valve seat and guide sub 140 is formed to define an upper internally threaded portion 142 that receives the lower externally threaded portion 144 of the inner tubular housing portion 54. At the upper portion of the valve seat and guide sub 140 is defined an annular flange structure 146 which forms a thrust shoulder 148 that is engaged by the lower extremity of the compression spring assembly 122. The lower extremity of the lower piston element 110 defines an upper annular thrust shoulder 150 that is positioned for engagement by the upper extremity of the compression spring assembly. As the piston assembly and valve actuator sleeve are moved downwardly under the influence of hydraulic pressure, the compression spring assembly 122 is compressed and thus stores mechanical energy of sufficient magnitude to force the piston assembly and the valve actuator sleeve upwardly when hydraulic fluid pressure within the chamber 88 is dissipated.

With regard now to FIGS. 2A–C and 3, the valve actuator sleeve 118 is bifurcated at its lower extremity defining a pair of opposed support arms 154 and 156 defining pivot apertures 158 and 160 that receive valve pivot elements 162 and 164, respectively. A valve element generally illustrated at 166 is also constructed of bifurcated configuration defining a pair of opposed support elements 168 and 170 that are formed to define pivot apertures 172 and 174, respectively. The central portion of the valve element 166 defines a convex sealing surface 176 that may be of partially spherical configuration and is adapted for seating engagement with an annular seat surface 178 defined at the lower extremity of the valve seat and guide sub 140. The seat surface 178 may also be of partially spherical configuration, if desired.

It is desirable that the valve element 162 have a certain degree of limited linear movement in respect to the valve seat 178 and that the valve element be capable of rotating 90° to a position where the valve element is clear of a straight through elongated flow passage that is defined by the internal cylindrical bores of the various internal components of the valve mechanism. This straight through cylindrical bore enables production fluid to flow with least resistance through the valve mechanism and further allows servicing tools to be run through the valve mechanism in the event downhole servicing is required below the level of the safety valve mechanism. 90° rotation of the valve mechanism may be conveniently accomplished by means of a rack element 180 that is supported within the housing structure by means of an end cap element 182 that is threadedly received at the lower extremity of the outer tubular body element 104. The rack element is formed of partially cylindrical configuration, as illustrated in FIG. 3, and defines opposed sets of rack gear teeth 184 and 186 that are engageable by opposed sets of pinion gear teeth 188 and 190 defined on the opposed valve support elements 168 and 170, respectively. As the valve actuator sleeve 118 moves downwardly, during a certain portion of such downward movement the pinion gear teeth of the valve element will engage the teeth of the rack element 180 and will cause 90° rotation of the valve element from the position illustrated in FIGS. 2C and 6B to the position illustrated in FIG. 6C.

It is a feature of this invention that the valve element 166 be capable of moving linearly into and away from contact with the annular seat surface 178. This is conveniently accomplished in the manner shown in FIGS. 2C, 6A and 6B. With the valve element 166 in or near the closed position as shown in FIGS. 6A and 6B, segmented coplanar valve guide surfaces 192 and 194 formed on each of the valve support elements 168 and 170 are capable of being oriented in substantially parallel relation shown in FIG. 6B, continued movement of the valve actuator sleeve in a downward direction, through interengagement between the pinion gear teeth and rack gear teeth, causes 90° rotation of the valve element from the position shown in FIG. 6B to the position shown in FIG. 6C.

The lower portion of the valve mechanism is designed to form a valve chamber 204 having a lower portion 206 thereof separated from the flowing fluid medium by means of a tubular partition 208. Between the tubular partition 208 and the outer tubular body portion of the valve mechanism, the lower portion of the valve chamber 204 defines a protective receptacle within which the arcuately curved head portion 210 of the valve element 166 is capable of being protectively located. After the valve element has been moved to the 90° rotated position illustrated in FIG. 6C, it is again appropriate to impart linear movement to the valve element to position the head portion 210 and the support elements 168 and 170 of the valve element within the protective enclosure. This feature is accomplished, as illustrated in FIGS. 6C and 6D. As shown in FIG. 6C, substantially planar elongated guide surfaces 212 are defined by the rack element 180, being disposed in substantially coplanar relation with opposed elongated surfaces 196 and 198. The opposed support elements 168 and 170 are formed to define substantially coplanar guide surfaces 214 and 216 that, in the position shown in FIG. 6C, are disposed in substantially parallel relation with the longitudinal axis of the valve flow passage. Guide surfaces 214 and 216 are capable of being positioned in sliding engagement with the elongated surfaces 212, thereby functioning to maintain the valve support elements 168 and 170 in the position shown in FIG. 6C as it is moved linearly to the position illustrated in FIG. 6D.

As the valve element 166 is moved in the opposite direction by the return spring 122 which imparts upward movement to the valve actuator sleeve 118, the pinion gear teeth 218 of each of the pinion gear segments will engage the corresponding rack gear teeth 184 and will initiate rotation of the valve element from the position illustrated in FIG. 6C to the position illustrated in FIG. 6B. After the valve element has been rotated to the position shown in FIG. 6B, continued upward movement of the valve actuator sleeve 118 will impart upward linear movement to the valve element 166 causing the sealing surface 176 of the head portion 210 of the valve element to move into direct sealing engagement with the annular sealing surface 178 of the valve seat and guide sub 140.

It is considered desirable to isolate the protective receptacle 206 from the flowing production fluid to prevent the valve element from being fouled or eroded by the production fluid. It is well known that oil and gas that is produced typically contains a certain amount of sand or other particulate that is eroded from the formation. Where safety valve elements are subjected to flowing production fluid, it is expected that wear may occur as sand and other particulate flows through the valve mechanism along with flowing production fluid. In accordance with the present invention, a pair of opposed pin elements 150 and 152 extend through apertures 220 and 222 formed in the valve actuator sleeve 118. Pins 150 and 152 extend through elongated slots 224 and 226 defined in the valve seat and guide sub 140 with the inner extremities of each of the pins being received within apertures 220 and 230 defined in a masking tube 232. The pin elements 150 and 152 function to establish a mechanical interconnection between the valve actuator sleeve 118 and the masking tube 232, causing the masking tube to be moved linearly along with the valve actuator sleeve 118. The cooperative relationship between the pin elements 150 and 152, the valve actuator sleeve 118 and the elongated slots 224 and 226 prevent the valve actuator sleeve from rotating within the valve housing and thereby confine the valve actuator sleeve solely to linear movement within limits defined by the length of the slots. The lower surfaces 234 and 236 of the slots define stop surfaces for engagement by the pins 150 and 152, respectively, to thus limit downward travel of the valve actuator sleeve during full opening movement and retraction of the valve element into its protective receptacle 206.

The lower extremity of the masking tube 232 is formed to define a tapered annular seating surface 238 that is slightly spaced from the sealing surface 176 of the valve element when the valve is closed. The tapered seating surface 238 is primarily provided for seating engagement with an oppositely tapered annular seating surface 240 defined at the upper extremity of a cooperative tubular masking element 242. As the valve element moves to the position illustrated in FIG. 6D, the masking tube 232 will be moved downwardly sufficiently to bring seating surfaces 238 and 240 into engagement. Although it is not intended that a positive seal be established when seating surfaces 238 and 240 are in engagement, it is intended that these surfaces fit sufficiently close that discernible fluid flow from the flow passage 242 into the valve chamber 204 and protective receptacle 206 will not occur. Thus, any particulate contained within the flowing production fluid will not enter the valve chamber and protective receptacle and the valve element will be protected against contamination or erosion by contaminants within the flowing production fluid.

It is desirable to provide a valve mechanism whereby formation pressure functions to assist the sealing ability of the valve and functions to assist in imparting closing movement to the valve mechanism. It is also desirable that the outer housing structure be free as possible from any severe pressure differential that might cause the housing to become damaged or ruptured. These features are conveniently accomplished in the valve mechanism illustrated in the various drawings. The valve actuator sleeve 118 is provided with an inner annular sealing element 244 that is retained within an annular seal groove defined in the valve actuator sleeve. The inner sealing element 244 establishes a seal between the valve actuator sleeve 118 and the valve seat and guide sub 140. The compression spring assembly 122 is maintained in at least slightly compressed condition at all times. Thus, in absence of any hydraulic pressure within the piston chamber, the spring assembly maintains the upper extremity of the upper piston element 108 in engagement with an annular stop surface 246 that defines the upper extremity of the piston chamber 88. Likewise, the compression spring acts against the annular shoulder surface 148 of the valve seat and guide sub 140 which functions as a stop surface by virtue of the threaded interconnection between the sub 140 and the inner tubular housing 54. The spring assembly 122 thus urges the sleeve piston upwardly, causing the valve actuator sleeve 118 to also be urged upwardly which results in closing movement of the valve element 166. The compression spring assembly 122 therefore continuously urges the valve element 166 toward its closed position. The valve is therefore maintained in its open position by hydraulic fluid pressure within the piston chamber. Should a hydraulic supply line rupture, therefore, the spring assembly 122 will automatically shift the valve actuating mechanism to a position closing the valve.

Formation pressure entering the valve mechanism through an inlet opening 248, defined by the end cap 182 that is connected to the lower extremity of the lower housing section 104, acts upon the exposed surface area defined by the valve element 166 in the closed position thereof, thus developing an upward force that is transmitted directly to the valve actuator sleeve and which assists the return spring 122 in moving the valve mechanism to its closed position and maintaining it closed. This closing movement will occur instantaneously and therefore relatively little flow will occur through the valve mechanism during the automatic closing sequence.

The outer housing of the valve mechanism may be of quite thin construction due to the pressure balanced nature thereof. The valve actuator sleeve and a majority of the piston assembly are not sealed with respect to the outer housing within which the same are movably received. Fluid pressure from the valve chamber 204 is therefore enabled to act on the inner surface area as well as the outer surface area of the outer housing. Since there exists no pressure differential across the outer housing structure regardless of the pressure to which the valve is subjected, the outer housing may be formed of relatively thin light-weight material, if desired.

The masking tube 232 is sealed with respect to the valve seat and guide sub 140 by an annular sealing element 252 that is retained within an annular internal groove defined within the sub 140. Sealing of the movable components of the valve mechanism is further enhanced by annular sealing elements 254 and 256 that are retained, respectively, within inner and outer annular grooves defined in the upper portion of the sub 140. Sealing element 254 establishes a seal between the valve seat and guide sub and the masking tube 232 while sealing element 256 establishes a seal between the sub 140 and the valve actuator sleeve 118. An O-ring type sealing element 258 is provided to establish a seal at the joint between the inner tubular housing portion 54 and the valve seat and guide sub 140.

In view of the foregoing, it is evident that with the valve element 166 in its closed position and sealed with respect to the sealing surface 178 of the valve seat and guide sub 140, there will exist a pressure differential across the valve element which develops a pressure induced resultant force that assits in maintaining the valve in its closed position. As mentioned above, it is desirable to provide a safety valve mechanism of the character described herein and which valve mechanism is capable of being pressure balanced for the purpose of eliminating any pressure induced resultant forces tending to maintain the valve element in the closed position thereof and thus minimizing valve actuator forces that cause opening of the valve mechanism. In accordance with the present invention, this feature is effectively accomplished by a mechanism that pressure balances the valve element during the initial portion of valve opening movement. As mentioned above, the piston assembly 98 is received within a piston chamber defined at the upper extremity thereof by end wall stop surface 246 and by inner and outer cylindrical surfaces 260 and 262. The inner cylindrical surface 260 is defined by the outer cylindrical surface of the inner tubular housing 54 while the outer cylindrical surface 262 is defined by an inner upper cylindrical surface portion of the intermediate housing section 90. The upper piston element 108 is received with the upper extremity thereof in close fitting relation with the surfaces 260 and 262 and with sealing relationship maintained therewith by means of annular sealing elements 264 and 266. The length of the outer cylindrical surface 262 extends from the upper extremity 268 of the intermediate housing section 90 to an internal enlargement that begins at 270. The length of the cylindrical surface 262 is sufficiently great to accommodate maximum linear movement of the upper piston element 108. The inner tubular housing 54 is formed to define a plurality of pressure balancing ports 272 that communicate the flow passage 250 of the valve mechanism with the piston chamber 88. A pair of annular sealing elements 274 and 276 are retained within closely spaced seal grooves 278 and 280 defined within the inner peripheral portion of the upper piston element 108 and, in the closed position of the valve element and maximum upper position of the upper piston element, sealing elements 274 and 276 bridge the pressure balancing ports 272 and prevent communication of fluid pressure from the flow passage 250 to the piston chamber 88. The upper piston element 108 is formed to define an annular enlarged or relieved portion 282 that cooperates with the inner tubular housing to define an elongated annulus or pressure balancing chamber 284. The pressure balancing chamber 284 is communicated with the annulus 286 between the piston assembly and intermediate housing section by means of a plurality of pressure balancing ports 288 that are formed through the upper piston element 108.

As also mentioned above, the formation pressure sensed by the valve mechanism is communicated along the inner surface area of the outer housing in order that the outer housing is pressure balanced to eliminate any need for the outer housing to withstand any pressure differential. In fact, the formation pressure sensed by the valve mechanism is communicated upwardly between the outer housing and the valve actuator sleeve 118 by virtue of the loose fit and unsealed relation therebetween. This formation pressure is further communicated upwardly between the outer housing and the piston assembly 98 by virtue of the loose fitting, unsealed relation therebetween. In fact, fluid pressure is transmitted upwardly to the seal 266 which restricts the fluid pressure from the piston chamber 88.

Upon downward movement of the upper piston element 108 sufficient to establish communication between the annular chamber 284 and the pressure balancing ports 272 formation pressure will be communicated to the flow passage 250 and will thereby act upon the downstream side of the valve element 166, thus pressure balancing the valve element and dissipating any pressure induced force that might otherwise assist in maintaining the valve element in its closed position.

The lower piston element 110 is positioned with the lower annular extremity 150 thereof in abutting relation with the upper extremity of the spring assembly 122 and is sealed with respect to the inner tubular housing 54 by means of an annular sealing element 292. A lost-motion spring biased connection is established between the upper and lower piston elements 108 and 110 which allows the upper piston element 108 to move linearly with respect to the lower piston element and thus allow the pressure balancing activity to occur before a significant valve opening force is applied through the valve actuator sleeve mechanism. As shown in FIG. 7A, the upper and lower piston elements are formed to define a plurality of generally parallel spring retainer bores 294 and 296 which are disposed in generally equally spaced parallel relation about the periphery of the respective upper or lower piston element. These opposed blind bores are adapted, respectively, to receive upper and lower extremities of a plurality of compression spring members 298 that function in absence of an opposing force, to apply forces to the upper and lower piston elements and maintain them in spaced relation. Since the opposed extremities 300 and 302 of the upper and lower piston elements may be positioned in spaced relation, it is appropriate to strengthen the compression spring so as to bridge the space therebetween. A plurality of spring strengthening rod elements 304 are positioned within each of the springs with each rod being of sufficient length to ensure that the space between the opposed piston extremities is bridged at all times. The rods 304 are also of sufficiently restricted length to allow the opposed extremities 300 and 302 of the pistons to move into abutting relation.

It is desirable to limit maximum spacing of the opposed extremities 300 and 302 of the piston elements and this feature is accomplished by means of a lost-motion connection in the manner illustrated in the various figures. The upper piston element 108 is formed to define a downwardly extended portion 306 that is of generally semicircular configuration while the lower piston element 110 is formed to define a mating, generally semicircular upwardly projecting portion 308. On each side of the semi-cylindrical portion 306 of the upper piston element is provided a pair of transverse stop projections 310 while the lower piston element is formed to define similar transverse stop projections 312. The stop projections 310 and 312 are assembled in interlocked relation in the manner illustrated particularly in FIG. 7A with the compression springs 298 being slightly compressed. Thus assembled, the upper and lower piston elements are inserted into the annular piston receptacle defined between the inner and outer housing structures and the inner and outer housing structures prevent relative transverse movement of the piston elements that might otherwise allow the compression springs to shift the projections 310 and 312 past one another. In FIG. 7A, the lost-motion connection is shown in extended position thereof with transverse stop projections 310 and 312 in engaging relation. As shown in FIG. 7B, the upper piston element 108 has moved downwardly sufficiently to fully collapse the compression springs 298, thus bringing the opposed extremities 300 and 302 of the piston elements into abutting relation. This downward movement of the upper piston element relative to the downward piston element 110 causes shifting of the sealing elements 274 and 276 downwardly, thus establishing communication between the pressure balancing ports 272 and the pressure balancing chamber 284. The lower piston element 110 is therefore allowed to remain so positioned that the valve element 166 remains closed until such time as pressure balancing of the valve element has occurred and pressure induced closing force thereof has been dissipated. FIG. 7C illustrates the piston assembly being shifted to the valve open position responsive to further downward movement of the piston assembly responsive to hydraulic pressure within the piston chamber.

OPERATION

Ordinarily, the safety valve mechanism of this invention will be positioned at the lower extremity of a production tubing string extending within a well casing in the manner illustrated in FIG. 1. In absence of any hydraulic control, the valve mechanism will be maintained in its closed position by virtue of the activity of the spring assembly 122 which urges the piston assembly and valve actuator sleeve upwardly causing the valve support arms 154 and 156 to urge the valve element upwardly, thus moving it into sealed relationship with the spherical or tapered annular sealing surface 178. With the valve element closed and with a pressure differential existing between formation pressure within the valve chamber 204 and pressure within the flow passage 250 there will be developed a pressure induced resultant force that tends to hold the valve element 166 in its closed position. In the closed position of the valve element, therefore, pressure induced resultant forces may assist the spring assembly 122 in maintaining the valve element in its closed position.

When it is desirable to open the valve, pressurized hydraulic fluid is introduced into the piston chamber 88 through the fluid supply passage system including the passage structure defined by reference characters 68, 70, 72, 74, 82 and 84. The compression springs 298 of the lost-motion connection between the upper and lower piston elements 108 and 110 are considerably weaker than the compression springs of the spring assembly 122. As the piston assembly 98 is actuated, the upper piston element 108 will move first, thus shifting downwardly and causing the springs 298 to become compressed. This downward movement of the upper piston element causes the port blocking seals 274 and 276 to also shift downwardly thereby establishing communication between the pressure balancing ports 272 and the pressure balancing chamber 284. When this occurs, formation pressure within the valve chamber is communicated into the passage 250 and any pressure differential existing across the closed valve element is substantially dissipated. After this occurs, the upper piston element will have shifted to the collapsed position thereof as shown in FIG. 7B, and further piston movement will cause the lower piston element 110 to move downwardly, thus also urging the valve actuator sleeve 118 downwardly to cause the valve opening activity to occur. As the valve actuator sleeve 118 is shifted downwardly by the piston assembly, the valve element 166 will be moved downwardly in linear manner thus causing the sealing surface 176 of the valve element to become separated from the tapered seat surface 178 of the valve seat and guide sub 140. The valve element will thus be moved downwardly in linear manner until the first teeth of the pinion gear portions of the valve element engage the first teeth of the rack element 180. As downward movement of the valve actuator sleeve continues from this point, the rack and pinion gear teeth will interact, causing pivotal movement of the valve element from the position illustrated in FIG. 6B to the position illustrated in FIG. 6C. The valve element is thus rotated 90° and positioned for entry into its protective receptacle 206. The masking tube, being interconnected with the valve actuator sleeve 118 by means of connector pins 162 and 164, will move downwardly along with the valve actuator sleeve during opening movement of the valve mechanism. As shown in FIG. 6A, the masking tube 232 is fully retracted while the sealing surface of the valve element 166 is in sealing engagement with the annular seat surface 178. As the valve actuator sleeve 118 moves downwardly as shown in FIG. 6B, the masking tube will also initiate its downward movement. Upon rotation of the valve element to the position illustrated in FIG. 6C, the masking tube 232 will have moved further downwardly toward the upwardly extending tubular element 208. At the full open position as shown in FIG. 6D with the valve element fully retracted within its protective receptacle, the masking tube 232 will have moved downwardly sufficiently to bring its seating surface 238 into engagement with the opposing seating surface 240 of the tubular element 208. A completely cylindrical flow passage is therefore defined through the valve mechanism thereby enabling servicing tools to be passed through the valve mechanism, if desired, for downhole servicing operations. The substantially sealed relationship between surfaces 238 and 240 of the masking tube and its cooperative tubular element 208, assure that any particulate that might be contained within the production fluid will not impinge upon the valve element 166 or any of the valve actuator components and thus the valve mechanism will remain protected against damage or contamination by the fluid medium.

As long as hydraulic fluid pressure is maintained within the piston chamber 88, the valve mechanism will be maintained in its open position and fluid flow will be allowed to occur through the valve mechanism in the tubing string to which it is connected. In the event an undesirable pressure condition is sensed by means of appropriate sensing equipment or should a hydraulic fluid supply line rupture or for any other reason, the hydraulic fluid will be allowed to bleed from the chamber 88. When this occurs, the spring assembly 122 will urge the piston assembly 98 upwardly thereby also moving the valve actuator sleeve 118 upwardly which in turn causes the valve actuator sleeve to shift the valve element and masking tube upwardly. By virtue of its connection with the valve actuator sleeve, the valve element 166 will be moved upwardly thus bringing the teeth of the pinion gear into interacting contact with the corresponding teeth of the rack element 180. Further upward movement of the valve element causes it to rotate from the open position shown in FIG. 6C to the closed but unseated position as shown in FIG. 6B. Continued upward movement of the valve actuator sleeve under the influence of the spring assembly 122 causes the valve element to shift to the fully closed position shown in FIG. 6A. When this occurs, further flow through the valve mechanism and tubing string will be blocked and formation pressure within the valve chamber 204 will act upon the valve element to develop a pressure differential and thereby further influence its tightly seated and sealed relationship with respect to the spherical or tapered sealing surface 178.

The valve mechanism of this invention is shown and discussed herein in accordance with a preferred embodiment of simple construction and operation. It is not intended, however, to limit this invention solely to the construction and operational concepts discussed herein, it being obvious that the invention may take other convenient forms within the spirit and scope thereof. For example, this valve mechanism may be provided with a mechanical override system of similar nature as set forth in U.S. patent application Ser. No. 963,459. Further, this valve mechanism may conveniently take the form of a flow line control valve as is also set forth in U.S. patent Ser. No. 963,459.

In view of the foregoing, it is readily apparent that I have provided a novel valve mechanism that may be efficiently utilized either in a downhole well environment as a safety valve or storm choke or as a packing list hydraulically or pneumatically controlled valve for controlling the flow of fluid in flow lines. In each case, a valve mechanism is employed incorporating a valve element that may be retracted into a protected position where it may not be contacted by erosive materials contained within the flowing fluid handled by the valve mechanism. In a downhole well environment, the valve mechanism may function as a safety valve or storm choke incorporating combined forces of stored energy from a compression spring assembly and a force developed by formation pressure to maintain the valve closed after automatic or induced closure has occurred.

For the purpose of opening the valve mechanism, the valve element may be efficiently pressure balanced during an initial stage of the valve opening movement thereby dissipating any pressure induced closing force acting upon the valve and thus rendering the valve capable of being opened simply by overcoming the spring closing force thereof.

As a flow line control valve, a hydraulic actuating system may be provided for inducing opening and closing controlling movement to the valve mechanism and it will not be possible for the valve mechanism to leak fluid as might otherwise occur in the event of failure of a conventional operating stem packing. This feature promotes a valve mechanism that satisfactorily functions in hazardous environments and may be efficiently controlled at a substantial distance from the site of the valve itself.

In view of the nature of the valve mechanism, it is possible to achieve mechanical opening of the valve simply by passing an object through the bore of the valve, engaging the closed valve element with the object and applying sufficient downwardly directed force to force the valve element from its seat and move it downwardly to accomplish opening.

It is clearly evident, therefore, that I have provided a valve mechanism which incorporates all of the features and objects hereinabove set forth together with other features and objects which are inherent in the construction and operation of the valve mechanism itself. Although the present invention has been described in its particular application to downhole safety valves and has been mentioned in conjunction with its application to flow line valves, it is not intended to limit the invention in any manner whatever.

I claim:

1. A safety valve mechanism for controlling fluid through a conduit, said safety valve mechanism comprising:

a valve housing having a flow passage defined thereby, said valve housing defining a valve chamber and a protective receptacle in communication with said flow passage and valve chamber and located outwardly of said flow passage;

valve seat means being located within said valve chamber about said flow passage and defining a seat surface;

a valve element being movably positioned within said valve chamber and being linearly movable into seated engagement with said seat surface during closing movement thereof and being movable linearly away from said seat surface during opening movement thereof, said valve element being rotatably and linearly movable to a protected position within said protective receptable and in said protected position being out of the flow path of fluid flowing through said valve mechanism;

valve actuator means being contained within said valve housing, said valve actuator means being operatively interconnected with said valve element and inducing selective opening and closing movement of said valve element into and out of said seated engagement with said seat surface and inducing movement of said valve element into said protective receptacle during opening of said valve and causing movement of said valve element from said protective receptacle into said seated engagement with said seat surface during closing movement of said valve element, said valve actuator means communicating pressure from said valve chamber upstream of said valve element to the downstream portion of said valve element during initial opening movement of said valve actuator means and causing substantial dissipation of pressure induced resultant forces tending to maintain said valve element in the closed position thereof;

first actuator power means normally urging said valve element toward the closed position thereof; and second actuator power means being operative to overcome said first actuator power means and impart opening movement to said valve actuator means and valve element and to maintain said valve element in the open position thereof.

2. A safety valve mechanism as recited in claim 1, wherein:

said valve housing is formed to define pressure balancing passage means for communication of fluid pressure from said valve chamber to the downstream side of said valve element to cause substantial pressure balancing of said valve element; and said valve actuator means normally sealing said pressure balancing passage means and preventing occurence of said pressure balancing, said valve actuator means being movable out of said sealing relationship with said pressure balancing passage means during initial movement of said valve actuator means with said valve in the closed position thereof and allowing said substantial pressure balancing of said valve element to occur prior to initiation of opening movement of said valve element.

3. A safety valve mechanism as recited in claim 1, wherein:

said valve actuator means incorporates first and second relatively movable elements each defining abutment means and being positionable in an expanded position with said abutment means in spaced relation and a collapsed position with said abutment means in abutting engagement, said first of said relatively movable elements being operatively interconnected with said valve element and causing selective opening and closing movement of said valve element upon movement thereof relative to said valve housing;

means normally urging said first and second movable elements to said expanded position and said second power actuator means selectively overcoming said urging means and moving said first and second relatively movable elements to said collapsed position; and seal means being supported by said second movable element and sealing said pressure balancing passage means at said expanded position of said first and second movable elements, upon movement of said second movable element toward said collapsed position, said seal means moving out of sealed relation with said pressure balancing passage means and communicating said flow passage with said valve chamber.

4. A safety valve mechanism as recited in claim 3, wherein:

said valve housing defines a piston chamber;

means communicating pressurized operating fluid into said piston chamber; and said second relatively movable element including piston means received in movable relation within said piston chamber and being linearly movable responsive to the pressure of said operating fluid.

5. A safety valve mechanism as recited in claim 4, wherein:

a lost-motion interconnection is defined between said first and second relatively movable elements and includes stop means on each of said relatively movable elements, said stop means becoming engaged at said expanded position to limit further spacing of said abutment means.

6. A safety valve mechanism as recited in claim 5, wherein said urging means comprises compression spring means.

7. A safety valve mechanism as recited in claim 5, wherein said urging means comprises:

a plurality of spring receptacles being formed in each of said first and second relatively movable elements; and a plurality of compression springs each being receivable within individual ones of said spring receptacles.

8. A safety valve mechanism as recited in claim 7, wherein:

a plurality of spring support rods are provided, one being received within each of said compression springs and limiting transverse bending of said compression springs.

9. A safety valve mechanism as recited in claim 1, wherein:

said valve housing is formed to define a protective receptacle outside of said flow passage; and said valve element is positioned within said valve chamber and is movable through linear and pivotal components of movement, said valve element is linearly movable into and away from seated engagement with said valve seat means and is pivotally movable from a position within said flow passage to a protected position within said protective receptacle.

10. A safety valve mechanism as recited in claim 9, including:

cooperative guide surface means defined by said valve body and said valve element, said cooperative guide surface means allowing linear movement of said valve element relative to said valve body and providing a guiding function to maintain orientation of said valve element during such linear movement; and cooperative pivotal movement inducing means being formed on said valve body and valve element, said pivotal movement inducing means causing selective opening and closing pivotal movement of said valve element during a portion of said linear movement of said valve element relative to said valve body.

11. A safety valve mechanism as recited in claim 10, wherein said cooperative pivotal movement inducing means comprises:

a rack gear segment being defined by said valve body; and a pinion gear segment being defined by said valve element and being adapted for mating operative engagement with said rack gear segment during a portion of said linear movement of said valve element relative to said valve body.

12. A safety valve mechanism as recited in claim 10, including:

an elongated guide surface being defined within said valve body;

a rack segment being defined intermediate the extremities of said elongated guide surface;

a pair of guide surfaces being defined on said valve element, one of said guide surfaces being oriented in substantially normal relation with the other of said pair of guide surfaces; and a pinion gear segment being formed on said valve element and interconnecting each of said pair of guide surfaces, said pinion gear segment being adapted for mating operative engagement with said rack gear segment during a portion of said linear movement of said valve element relative to said valve body.

13. A safety valve mechanism as recited in claim 10, wherein said valve element comprises:

a valve head defining a sealing surface for engagement with said valve seat means;

a pair of spaced leg elements extending from said valve head;

an elongated valve sleeve being movably positioned within said valve body and defining a pair of spaced support extensions; and means establishing pivotal connections between said space valve support extensions and said spaced leg elements of said valve element.

14. A safety valve mechanism as recited in claim 10, wherein said valve element comprises:

a valve head defining a sealing surface for sealing engagement with said valve seat means;

a pair of spaced leg elements extending from said valve head, at least one of said leg elements defining a pinion gear segment;

rack gear means being defined within said valve housing and being engagable by said pinion gear segment to accomplish said pivotal movement of said valve element;

said valve actuator means including an elongated valve actuator sleeve being movably positioned within said valve housing and defining pivot connection means; and means establishing pivotal connection between said pivot connection means of said elongated valve actuator sleeve and said spaced leg elements of said valve element.

15. A safety valve mechanism as recited in claim 14, wherein said second actuator power means comprises:

an elongated hydraulic chamber being defined by said valve housing;

means communicating said hydraulic chamber with a controllable source of pressurized hydraulic fluid for selectively introducing pressurized hydraulic fluid into said hydraulic chamber and venting said hydraulic fluid from said chamber; and piston actuator means being interconnected with said elongated valve actuator sleeve and being located within said hydraulic chamber, said piston acutator means being linearly movable responsive to the pressure of said hydraulic fluid.

16. A safety valve mechanism as recited in claim 15, wherein said first actuator power means comprises:

a spring chamber being defined within said valve housing; and compression spring means being located within said spring chamber with one extremity thereof bearing against said valve housing and with the other extremity thereof bearing against said elongated valve actuator sleeve, said compression spring means urging said elongated valve sleeve toward a direction causing said cooperative valve actuator means to be actuated to the closed position thereof.

17. A safety valve mechanism as recited in claim 14, wherein:

partition means is movably positioned within said valve body, said partition means being movable from a retracted position within said valve housing to a protecting position wherein said partition means is in engagement with said valve housing and cooperates with said valve housing to define a partition for said protective receptacle separating said valve element from fluid flowing through said flow passage; and said elongated valve sleeve imparting movement to said partition means to said retracting and protecting positions.

18. A safety valve mechanism as recited in claim 9, wherein:

partition means being movably positioned within said valve housing, said partition means being movable from a retracted position within said valve housing to a protecting position where said partition means is in engagement with said valve housing and cooperates with said valve housing to define a partition for said protective receptacle separating said valve element from fluid flowing through said flow passage.

19. A safety valve mechanism as recited in claim 18, wherein:

said partition means is defined at least in part by an elongated tubular element, said elongated tubular element defining a part of said flow passage through said valve mechanism.

20. A safety valve mechanism as recited in claim 9, wherein said first actuated power means comprises compression spring capsule means engaging said valve body and said valve actuator means, said spring capsule means comprising:

a pair of annular spring retainer bodies, each being formed to define a plurality of elongated spring retainer recesses being oriented in generally parallel relation and substantially parallel to the elongated axis of said spring retainer bodies;

a plurality of helical compression springs being provided having the extremities thereof positioned within spring retainer recesses in each of said pair of spring retainer bodies; and inner support rods being positioned within each of said plurality of compression springs, the length of each of said inner support rods exceeding the maximum spacing of said spring retainer bodies.

21. A safety valve mechanism as recited in claim 20, wherein:

each of said spring retainer bodies is of generally cylindrical internal and external configuration; and each of said spring retainer recesses is of generally cylindrical configuration.

22. A safety valve mechanism as recited in claim 21, wherein:

each of said spring retainer recesses is formed to intersect the inner and outer generally cylindrical surfaces of said spring retainer bodies, thus defining a plurality of elongated generally parallel inner and outer slots exposing said compression springs.

23. A safety valve mechanism as recited in claim 1, wherein said valve actuator means comprises:

a first actuator element defining first abutment means and being movably positioned within said valve housing, said first actuator element being operatively interconnected with said valve element and inducing opening and closing movements to said valve element upon movement thereof within said valve housing;

a second actuator element defining second abutment means being movably positioned within said valve housing and being disposed in relatively movable relation with said first actuator element;

means normally urging said first and second actuator elements to an extended position positioning said first and second abutment means in spaced relation, said second actuator power means being capable of applying an opening force to said second actuator element overcoming said urging means and causing movement of said second actuator element toward a collapsed position where said first and second abutment means are in abutting engagement;

said valve housing defining pressure balancing port means capable of communicating pressure within said valve chamber to the downstream side of said valve element to pressure balance said valve element and dissipate pressure induced resultant force acting in opposition to opening movement of said valve element; and pressure balancing seal means being provided on said second actuator element and sealing said pressure balancing ports in the extended position of said first and second actuator elements, said pressure balancing seal means being shifted by said second actuator element during movement thereof toward said collapsed position and allowing said pressure balancing communication of fluid pressure from said valve chamber to the downstream side of said valve element.

24. A valve mechanism for controlling the flow through a conduit, said mechanism comprising:

a valve housing defining inlet and outlet openings and a valve chamber, said valve mechanism defining a protective receptacle within said valve housing;

valve seat means being located within said valve chamber and defining a seat surface;

a valve element being movably positioned within said valve chamber and being linearly movable into seated engagement with said seat surface during closing movement thereof and being movable linearly away from said valve seat means during opening movement thereof, said valve element being rotatably and linearly movable to a protected position within said protective receptacle and in said protected position being out of the flow path of fluid flowing through said valve mechanism;

valve actuator means being contained within said valve housing, said valve actuator means being operatively interconnected with said valve element and inducing selective opening and closing movement of said valve element into and out of said seated engagement with said seat surface and inducing movement of said valve element into said protective receptacle during opening of said valve and causing movement of said valve element from said protective receptacle into said seated engagement with said seat surface during closing movement of said valve element, said valve actuator means communicating pressure from said valve chamber upstream of said valve element to said valve element downstream of said valve element during initial opening movement of said valve actuator means and causing substantial dissipation of pressure induced resultant forces tending to maintain said valve element in the closed position thereof; and means for selectively inducing actuating movement of said valve actuator means.

25. A valve mechanism as recited in claim 24, wherein said valve actuator means comprises:

piston chamber means being defined within said valve body;

a piston element being movably positioned within said piston chamber means;

means for selectively introducing pressurized fluid into said piston chamber means to cause selective linear movement of said piston means; and means interconnecting said valve element and said valve actuator means and inducing said selective opening and closing movement to said valve element responsive to selective fluid energization of said piston means.

26. A mechanism as recited in claim 25, wherein said valve actuator means further comprises:

cooperative guide surface means defined by said valve body and said valve element, said cooperative guide surface means allowing linear movement of said valve element relative to said valve body and providing a guiding function to maintain orientation of said valve element during such linear movement; and cooperative pivotal movement inducing means being formed on said valve body and valve element, said pivotal movement inducing means causing selective opening and closing pivotal movement of said valve element during a portion of said linear movement of said valve element relative to said valve body.

27. A valve mechanism as recited in claim 26, wherein said cooperative pivotal movement inducing means comprises:

an elongated guide surface being defined within said valve body;

a rack gear segment being defined intermediate the extremities of said elongated guide surface;

a pair of guide surfaces being defined on said valve element, one of said guide surfaces being oriented in substantially normal relation with the other of said pair of guide surfaces; and a pinion gear segment being formed on said valve element and interconnecting each of said pair of guide surfaces, said pinion gear segment being adapted for mating operative engagement with said rack gear segment during a portion of said linear movement of said valve element relative to said valve body.

28. A mechanism as recited in claim 25, wherein said cooperative pivotal movement inducing means comprises:

a rack gear means being defined within said valve body; and pinion gear means being defined by said valve element and being adapted for mating operative engagement with said rack gear means during a portion of said linear movement of said valve element relative to said valve body.

29. A valve mechanism as recited in claim 24, wherein said valve element comprises:

a valve head defining a sealing surface for engagement with said valve seat means;

a pair of spaced leg elements extending from said valve head;

an elongated valve sleeve being movably positioned within said valve body and defining a pair of spaced support extensions; and means establishing pivotal connections between said spaced valve support extensions and said spaced leg elements of said valve element.

30. A valve mechanism as recited in claim 24, wherein said valve element comprises:

a valve head defining a sealing surface for sealing engagement with said valve seat means;

a pair of spaced leg elements extending from said valve head, at least one of said leg elements defining a pinion gear segment;

rack gear means being defined within said valve body and being engageable by said pinion gear segment to accomplish said pivotal movement of said valve element;

a valve support body being movably positioned within said valve body and defining pivot connection means; and means establishing pivotal connection between said pivot connection means of said valve support body and said spaced leg elements of said valve element.

31. A safety valve mechanism as recited in claim 30, wherein said actuator means includes:

hydraulic chamber means being defined within said valve body;

means selectively communicating said hydraulic chamber means with a controllable source of pressurized hydraulic fluid for selectively introducing pressurized hydraulic fluid into said hydraulic chamber means and venting said hydraulic fluid from said hydraulic chamber means;

piston means being movably positioned within said hydraulic chamber means; and said valve support body being connected to said said piston means and being linearly movable responsive to selective control by said source of hydraulic fluid.

32. A valve mechanism as recited in claim 30, wherein:

partition means is movably positioned within said valve body, said partition means being movable from a retracted position within said valve body to a protecting position wherein said partition means is in engagement with said valve body and cooperates with said valve body to define a partition for said protective receptacle separating said valve element from fluid flowing through said flow passage; and said valve support body imparting movement to said partition means to said retracting and protecting positions.

33. A valve mechanism as recited in claim 24, wherein:

partition means is movably positioned within said valve body, said partition means being movable from a retracted position within said valve body to a protecting position where said partition means closes said protective receptacle and isolates said valve element from the path of fluid flowing through said valve mechanism.

34. A valve mechanism as recited in claim 33, wherein:

said partition means is defined at least in part by an elongated tubular element, said elongated tubular element defining a part of a straight through flow passage defined by said valve mechanism.

35. A safety valve mechanism for controlling fluid through a conduit, said safety valve mechanism comprising:

a valve housing having inner and outer tubular housing members cooperating to define a piston chamber therebetween, said valve housing defining a flow passage and a valve chamber in communication with said piston chamber, said inner housing member defining pressure balancing port means communicating said piston chamber and said flow passage;

valve seat means being located in said valve chamber;

a valve element being movably positioned within said valve chamber, said valve element being adapted for a linear component of movement relative to said valve seat means and a rotary component of movement during opening and closing movements thereof;

valve actuator means being operatively interconnected with said valve element and being linearly movable within said valve housing, said valve actuator means incorporating piston means being linearly movable within said piston chamber, first seal means establishing a sealed relation between said piston means and said valve housing and defining a variable volume power fluid chamber at one extremity of said piston, second seal means being movable with said piston and sealing said pressure balancing port means in the normally closed position of said valve element, said second seal means being capable of an increment of linear movement with said valve closed sufficient to communicate said pressure balancing port means with said piston chamber, thus causing substantial pressure balancing of said valve element prior to opening movement thereof and, thus allowing linear opening movement of said valve element by said valve actuator means substantially free from any pressure induced resulting forces;

spring means normally urging said valve element toward the closed position thereof; and fluid power means being operative to apply fluid energized force to said piston to overcome the force of said spring means and impart opening movement to said valve actuator means and valve element and to maintain said valve element in the open position thereof.

* * * * *